US011293214B2

(12) United States Patent
Ostroviak et al.

(10) Patent No.: US 11,293,214 B2
(45) Date of Patent: Apr. 5, 2022

(54) EXTERIOR DOOR AND METHODS FOR FORMING EXTERIOR DOORS

(71) Applicant: GND Holdings LLC, Maple Grove, MN (US)

(72) Inventors: Ty Ostroviak, Maple Grove, MN (US); Jessie M. Otto, Maple Grove, MN (US)

(73) Assignee: GND Holdings LLC, Maple Grove, MN (US)

( * ) Notice: Subject to any disclaimer, the term of this patent is extended or adjusted under 35 U.S.C. 154(b) by 23 days.

(21) Appl. No.: 16/887,082

(22) Filed: May 29, 2020

(65) Prior Publication Data

US 2020/0378178 A1 Dec. 3, 2020

Related U.S. Application Data

(60) Provisional application No. 62/937,774, filed on Nov. 19, 2019, provisional application No. 62/855,673, filed on May 31, 2019.

(51) Int. Cl.
*E06B 3/70* (2006.01)
*E06B 3/78* (2006.01)

(52) U.S. Cl.
CPC ..... *E06B 3/7001* (2013.01); *E06B 3/7015* (2013.01); *E06B 3/78* (2013.01); *E06B 2003/7023* (2013.01)

(58) Field of Classification Search
CPC ..... E06B 3/78; E06B 3/7015; E06B 3/7001; E06B 5/20; E06B 3/74; E06B 3/72; E06B 2003/7049; E06B 3/70; E06B 3/44; E06B 3/20
See application file for complete search history.

(56) References Cited

U.S. PATENT DOCUMENTS 6,024,908 A * 2/2000 Koncelik ..... B29C 43/003 264/331.11
8,999,478 B1 * 4/2015 Medlen ..... B44C 1/22 428/99
2005/0016694 A1 * 1/2005 Jella ..... E06B 3/7001 160/236
2008/0016820 A1 * 1/2008 Robbins, Sr. ..... E06B 3/82 52/784.11
2009/0113830 A1 * 5/2009 Clark ..... E06B 3/5892 52/455
2010/0077664 A1 * 4/2010 Stensland ..... E05D 15/242 49/197

(Continued)

FOREIGN PATENT DOCUMENTS

CA 3081504 A1 * 11/2020 ..... E06B 3/7001

*Primary Examiner* — Beth A Stephan
(74) *Attorney, Agent, or Firm* — Schwegman Lundberg & Woessner, P.A.

(57) ABSTRACT

A door assembly can include a core layer, a backing layer, and a façade layer. The core layer can define a façade side and a back side opposite the façade side. The core layer can include a rail and a plurality of stiles coupled to the rail. The backing layer can be adhered to the back side of the core layer. The façade layer can be adhered to the façade side of the core layer. The façade layer can include a plurality of frame segments defining an outer surface comprised of polymer and the plurality of frame segments defining a mating surface adhered to the façade side of the core layer.

17 Claims, 21 Drawing Sheets

(56) References Cited

U.S. PATENT DOCUMENTS

| | | | | |
|---|---|---|---|---|
| 2010/0199572 | A1* | 8/2010 | Fimbel, III | B44F 11/00 49/506 |
| 2012/0131871 | A1* | 5/2012 | Caulk | E06B 3/822 52/455 |
| 2017/0030140 | A1* | 2/2017 | Nelson | E06B 5/20 |
| 2017/0241190 | A1* | 8/2017 | MacDonald | C08F 10/00 |

* cited by examiner 200
204
260
261
262
265

264
266

EXTERIOR DOOR AND METHODS FOR FORMING EXTERIOR DOORS

CLAIM OF PRIORITY

This patent application claims the benefit of priority, under 35 U.S.C. Section 119(e), to Ty Ostroviak et al. U.S. Patent Application Ser. No. 62/855,673, entitled "EXTERIOR DOOR AND METHODS FOR FORMING EXTERIOR DOORS," filed on May 31, 2019 and to Ty Ostroviak et al. U.S. Patent Application Ser. No. 62/937,774, entitled "EXTERIOR DOOR AND METHODS FOR FORMING EXTERIOR DOORS," filed on Nov. 19, 2019, each of which is hereby incorporated by reference herein in its entirety.

BACKGROUND

Garage doors and access doors are used throughout the world to protect contents within a building or structure from the elements while providing access to the structure. Because doors provide protection from elements such as wind, solar, and moisture exposure, doors are subject to erosion or wear over time. The exterior look of exterior doors, such as overhead sectional garage doors and pre-hung swing doors, is important to many homeowners.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

FIG. 2 illustrates a focused isometric view of a portion of a door assembly.

DETAILED DESCRIPTION

The exterior look of exterior doors, such as overhead sectional garage doors and access doors, is important to many property owners. In some cases, the look and feel of real wood is desirable; however, due to exposure of the wood to erosive conditions, use of real wood in doors requires regular and sometimes expensive maintenance to maintain the look and integrity of the door. For example, wood exterior doors are often enameled or stained. Such surface treatments require maintenance at regular intervals depending on exposure of the door to solar radiation and harsh weather. Often, maintenance involves either an additional topcoat or a complete strip to bare wood and refinish of the wood doors, which can be a long-term reoccurring expense. Many current composite wood-like exterior door products still require a clear coat application yearly to maintain a rich wood-like appearance and to prevent fading. Some doors use composite products, but require fasteners to secure the composite products to doors. Such fasteners can be unsightly and can be a source for water infiltration.

This disclosure helps to address these issues by providing a multi-layered door assembly including a façade or external layer that is made of non-wood materials but has a wood-like look or finish, such as polymer-capped Polyvinyl Chloride (PVC). The polymer-capped PVC layer can be adhered to a core layer without fasteners extended through the surface of the façade layer. The core layer can be further adhered to a backing layer. Such a product can provide the look and feel of wood that is desired while also helping to provide protection from erosion and, which, in turn, helps to reduce maintenance costs and efforts.

The above discussion is intended to provide an overview of subject matter of the present patent application. It is not intended to provide an exclusive or exhaustive explanation of the invention. The description below is included to provide further information about the present patent application.

FIGS. 1-17 illustrate portions of a sectional garage door 100 that can include a polymer capped PVC layer that can be adhered to an insulated door core without the need for any type of mechanical fasteners. The assembly 100 is discussed in further detail below.

Figure 1:
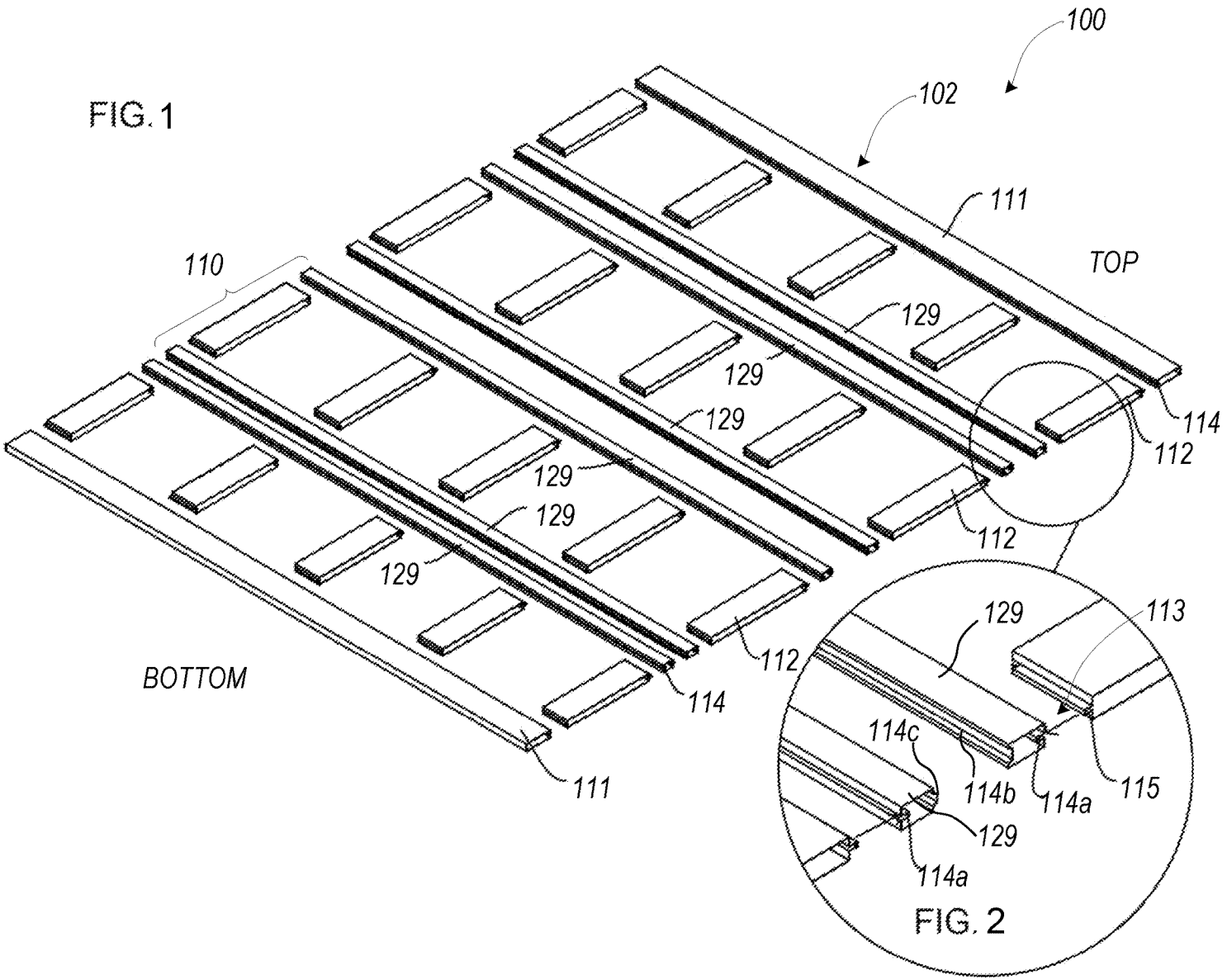
FIG. 1 illustrates a front isometric view of a portion of a door assembly.

FIG. 1 illustrates a front isometric view of a portion of a door assembly 100. FIG. 2 illustrates a focused isometric view of a portion of the door assembly. FIGS. 1 and 2 are discussed together below.

The assembly 100 can include a core layer 102, as shown in FIG. 1, which can define a façade side 107 and a back side 109. The core layer 102 can include a top rail 111, a bottom rail 111, intermediate rails 129, and stiles 112. The intermediate rails 129 and stiles 112 can be assembled to form sections 110.

The top rail 111, the bottom rail 111, the intermediate rails 129, and the stiles 112 can be rigid or semi-rigid components made of one or more of metals, plastics, foams, elastomers, ceramics, composites, combinations thereof, or the like. In some examples, the top rail 111, the bottom rail 111, and the intermediate rails 129 can be made of wood, such as Douglas Fir, Pine, Cedar, or the like.

The top rail 111 can be a beam, board, or the like, extending across most of, or an entirety of, a top portion of the core layer 102. Similarly, the bottom rail 111 can be a beam, board, or the like, extending across most of, or an entirety of, a bottom portion of the core layer 102. The intermediate rails 129 can be located between the top rail 111 and the bottom rail 111 and can extend across most of, or an entirety of, the core layer 102. The stiles 112 can be relatively shorter segments connected to the top rail 111 and one of the intermediate rails 129, between intermediate rails 129, or between the bottom rail 111 and one of the intermediate rails 129.

The top rail 111, bottom rail 111, and intermediate rails 129 can be cut to required lengths for the dimensions of a garage door. The stiles 112 can also cut to a desired length and then machined to create the joint 113, as shown in FIG. 2.

The stiles 112 can be connected to one of the rails 129 at a finger joint 113. The stiles 112 can include a finger 115 on respective ends and the rails 129 and 111 can include a slot 114*a* configured to receive the finger 115 therein. The intermediate rails 129 can also include a second slot 114*b* or a finger 114*c* which can allow adjacent intermediate rails 129 to form a finger joint for mating of the intermediate rails 129, as shown in FIG. 2. The finger joints 113 can be between 25 millimeters and 35 millimeters. In some examples, the finger joint 113 can be 30.16 millimeters (1.1875-inches) thick.

Figures 3, 4, 5:
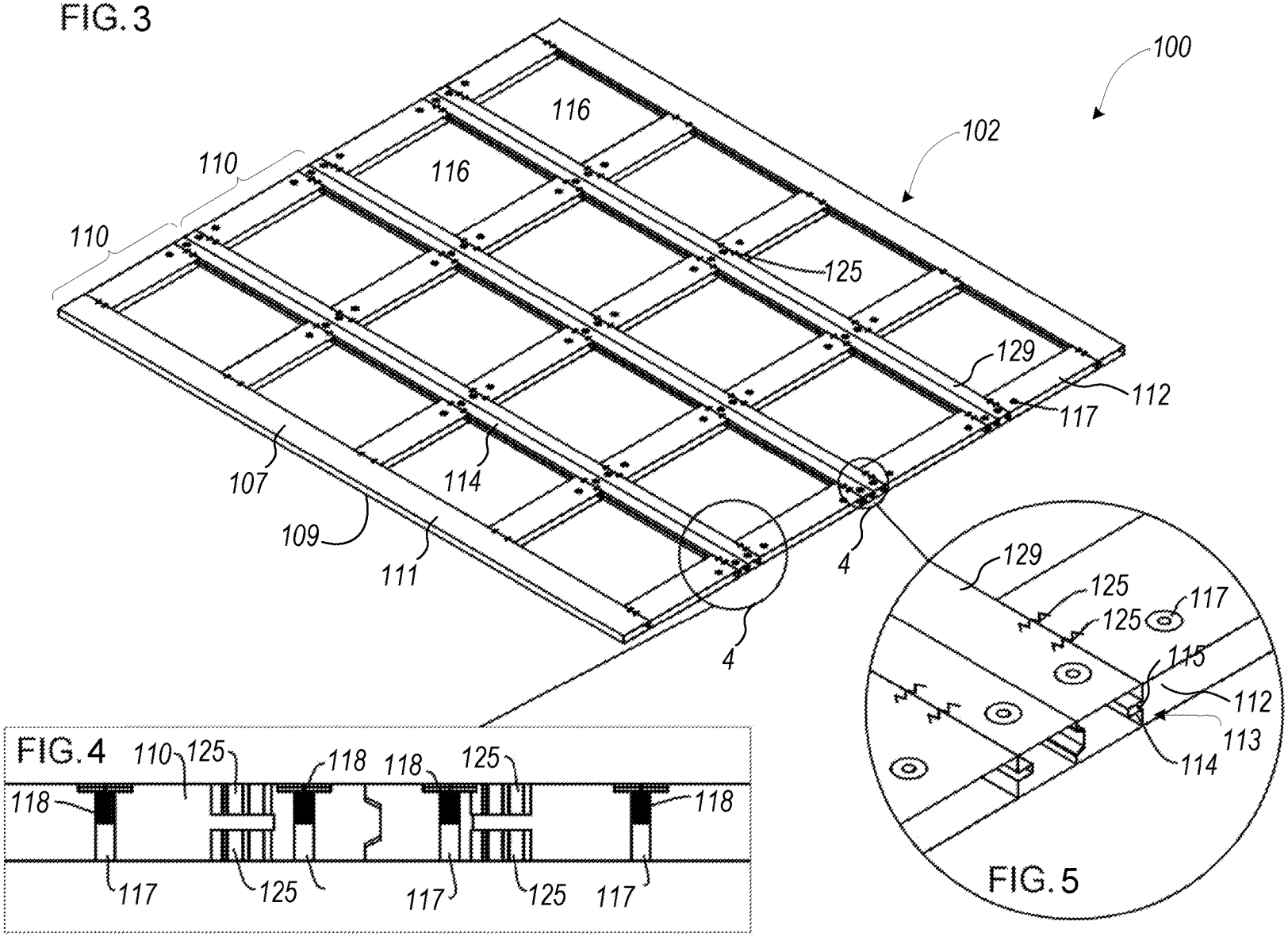
FIG. 3 illustrates a front isometric view of a portion of a door assembly.
FIG. 4 illustrates a focused isometric view of a portion of a door assembly.
FIG. 5 illustrates a focused isometric view of a portion of a door assembly.

FIG. 3 illustrates a front isometric view of a portion of the door assembly 100. FIG. 4 illustrates a cross-section view of a portion of the door assembly 100. FIG. 5 illustrates a focused isometric view of a portion of the door assembly 100. FIGS. 3-5 are discussed below together.

The door assembly 100 of FIGS. 3-5 can be consistent with FIGS. 1 and 2 above; FIGS. 3-5 show additional details of the door assembly. For example, FIGS. 3-5 show the assembled core layer 102, which can include counterbores 117. The counterbores 117 can be single diameter circular bores in other examples. The counter bores 117 can extend through or substantially through the stiles 112 and intermediate rails 129. The counterbores 117 can be configured to receive a T-nut 118 therein, as shown in FIG. 4, and can be configured to receive other fasteners, such as bolts, nuts, rivets, screws, or the like. The T-Nuts 118 can be inserted into the counterbores 117 and can be threaded to receive a bolt therein to secure door mounting hardware to the door assembly 100.

FIG. 5 shows the assembled joints 113 where the fingers 115 are inserted into the slots 114 to engage and join the stiles 112 with the intermediate rails 129. The rails 129 and 111 can be similarly joined through finger joints. In some examples, the joints 113 can be a 12.7-millimeter (0.5-inch) by 6.35-millimeter (0.25-inch) inch rabbet joint. The joints 113 can be clamped and the fingers 115 can be adhered into the slots 114 of the intermediate rails 129.

Once the joints 113 are secured, the rails 111 and 129 and stiles 112 can be clamped. Nails 125 can then be secured to the rails 111 and 129 and stiles 112 to secure the joints 113. The nails 125 can be corrugated nails such as corrugated nails between 6 millimeters and 26 millimeters. In some examples, the nails 125 can be 12.7-millimeter (0.5-inch) corrugated nails. Joints between intermediate rails 129 may not receive nails 125 to allow the sections 110 to move relative to each other, such as during operation of the door assembly 100.

Insulation 116 can be inserted in open areas at least partially defined by the stiles 112 and the rails 111 and 129, which can help increase thermal performance of the door assembly 100. The insulation can be fiberglass, polystyrene, polyisocyanurate, or the like.

Figure 6:
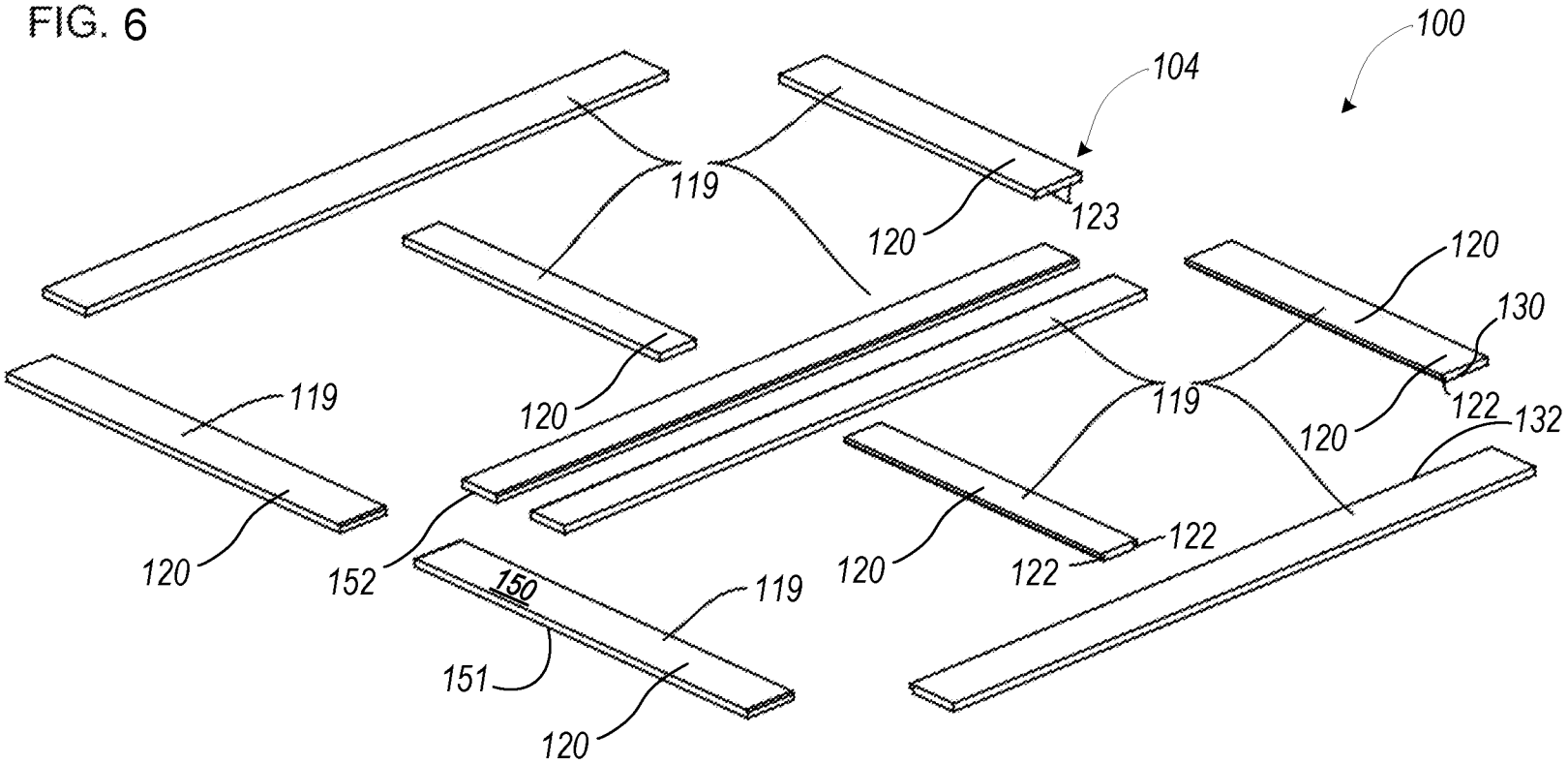
FIG. 6 illustrates a front isometric view of a portion of a door assembly.
Figure 8:
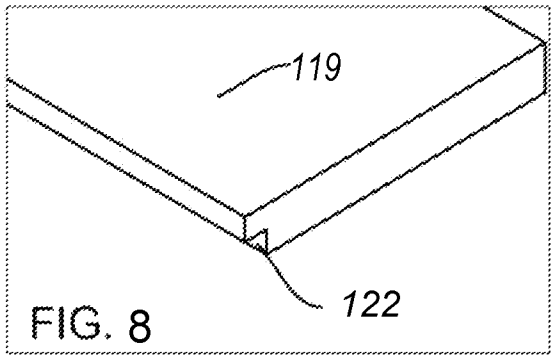
FIG. 8 illustrates a focused isometric view of a portion of a door assembly.
Figure 7:
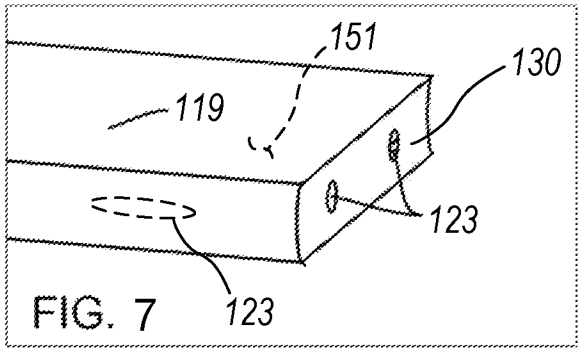
FIG. 7 illustrates a focused isometric view of a portion of a door assembly.

FIG. 6 illustrates a front isometric view of a portion of the door assembly 100. FIG. 7 illustrates a focused isometric view of a portion of the door assembly 100. FIG. 8 illustrates a focused isometric view of a portion of the door assembly 100. FIGS. 6-8 are discussed below together.

The door assembly 100 can be consistent with the door assembly 100 discussed above with respect to FIGS. 1-5; FIGS. 6-8 focuses on details of a façade layer 104. The façade layer 104 can include a plurality of frame segments 119 defining an outer surface 150 and a mating surface 151. The outer surface 150 can be comprised of polymer which can surround a core 152 of the frame segments 119. In some examples, the frame segments 119 can be made of polymer-capped Polyvinyl Chloride (PVC), wood and polymer composites, polymer composites, polymers, or the like. The core 152 can be made of various types of polymers. In some examples, the core 152 can be made of PVC.

In some examples, the polymer outer surface 150 can be removed from the core 152 to create the mating surface 151. That is, the polymer-cap surface can be removed from one side of the frame segments 119, such as by a sanding, scraping, planning, or other material removal process. In some examples, the polymer cap can be sanded off by three passes in a wide belt sander. Removal of the polymer cap can help to allow the mating surface 151 adhere to the core layer. In some examples, the frame segments can be un-capped and the core 152 can define the mating surface 151 such that removal of the polymer cap is not required.

FIG. 6 shows how the frame segments 119 can be positioned to form or develop frames within the façade layer 104. The frame segments 119 can include rail members 120, which can be cut to a required length and can be positioned between vertical frame segments 119.

The frame segments 119 can also include rabbeted edges 122 that can face substantially inward to receive and support paneling, as discussed below with respect to FIGS. 11-14. The rabbeted edges 122 are shown more clearly in FIG. 8 and can be substantially L-shaped. Other joint types can be used such as dovetails, fingers, mortise and tenon, or the like.

As shown in FIG. 7, ends of the frame segments 119, such as an end 130, can be shaped to have an interface configured to engage an edge portion 132 of any other of the frame segments 119. The ends 130 can be shaped or machined such as by using a routing or cutting or material removal process.

The end 130 can be machined to define an arcuate shape. The arcuate shape of the end 130 can be concave and the arcuate shape of the edge 132 can be convex such that the edge 132 end 130 and the edge 132 are complementary and configured to mate. Such a shape of the end 130 can help to simplify assembly because manufacturers of polymer boards often provide an edge (such as the edge 32) with a convex shape. The end 130 helps to allow for mating with a convex (or factory) edge to obtain a tight fit between the frame segments without using custom materials, which can help to reduce manufacturing and material costs.

The frame segments 119 can also include pocket holes 123 extending through the outer surface 150 of the frame segment 119 (such as through the mating surface 151) that is optionally not visible following securing of the façade layer 104 to the core layer 102, such as when the mating surface 151 is adhered to the façade side 107 of the core layer 102, as discussed below with respect to FIG. 15. The pocket holes 123 can extend through (or at least partially through) the frame segments 119 and can extend out the end 123 of the frame segments 119. The pocket holes 123 can be configured to receive a fastener therein or therethrough, as discussed in FIG. 10 below.

Figures 9, 10:
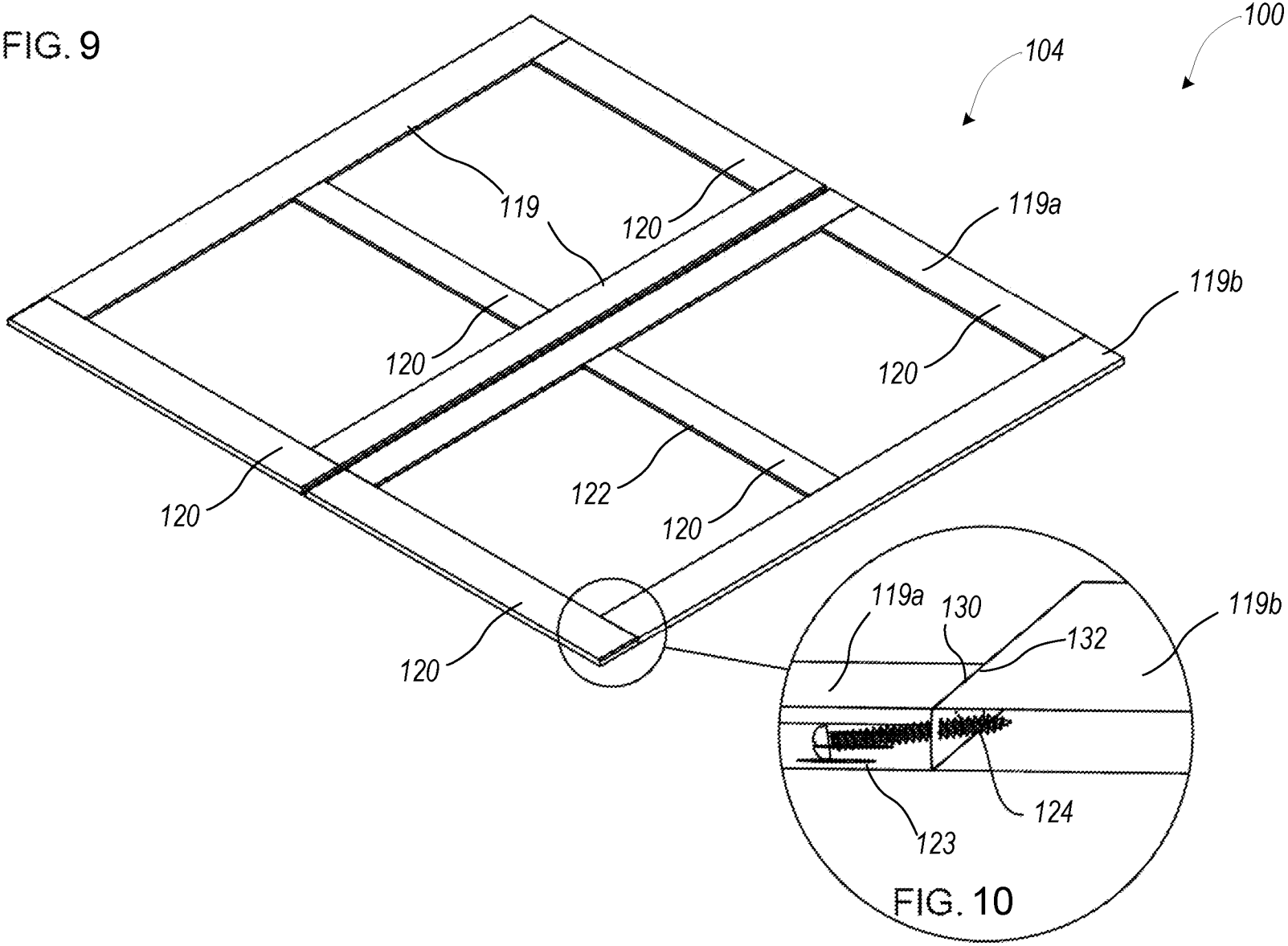
FIG. 9 illustrates a front isometric view of a portion of a door assembly.
FIG. 10 illustrates a focused isometric view of a portion of a door assembly.

FIG. 9 illustrates a front isometric view of the façade layer 104 of the door assembly 100. FIG. 10 illustrates a focused isometric view of a portion of the façade layer 104 of the door assembly 100. FIGS. 9 and 10 are discussed together below.

The door assembly 100 of FIGS. 9 and 10 can be consistent with the door assembly 100 discussed above with respect to FIGS. 1-8; FIGS. 9 and 10 show the façade layer 104 after the frame segments 119 are secured to each other, such as by using fasteners 124 through the pocket holes 123 of a first frame segment 119*a* and into a second frame segment 119*b* until the end 130 of the first frame segment 119*a* engages the edge 132 of the second frame segment 119*b*. Other frame segments 119 can be similarly joined. Once the frame segments 119 are assembled, the rabbet joints 122 can face inward, toward each other, to form a mounting provision for panels, as discussed below.

Figure 11:
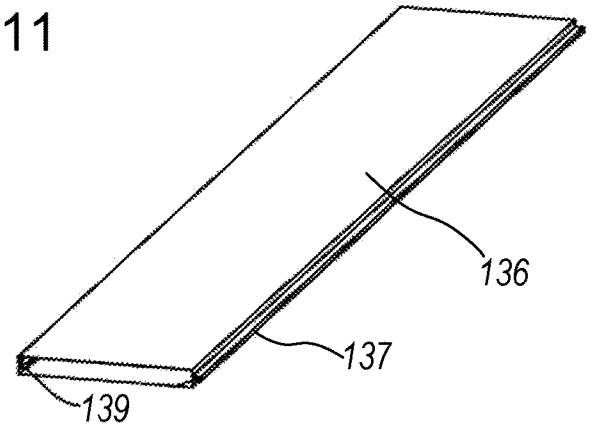
FIG. 11 illustrates a front isometric view of a portion of a door assembly.
Figure 12:
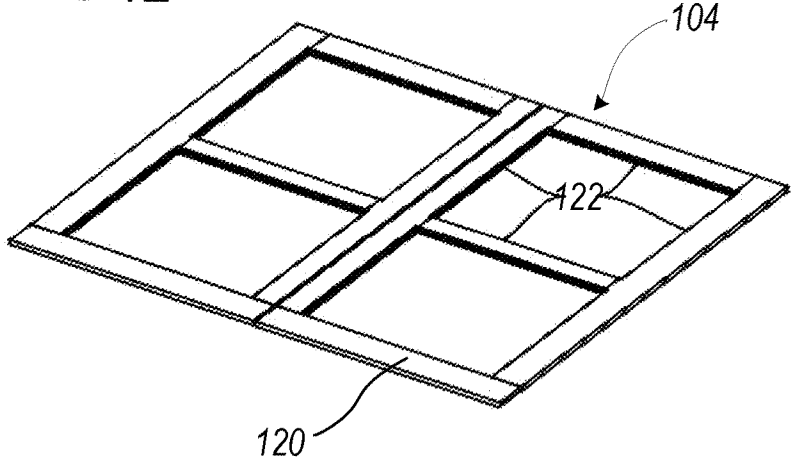
FIG. 12 illustrates a back isometric view of a portion of a door assembly.
Figure 13:
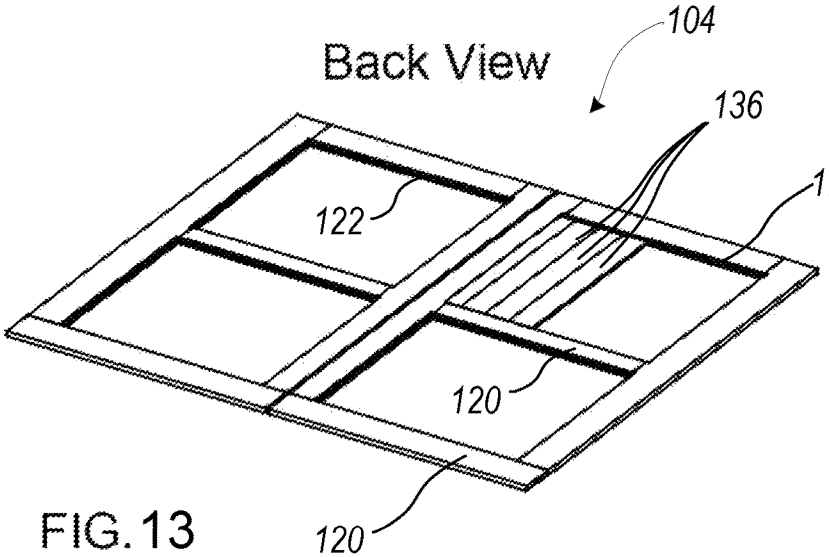
FIG. 13 illustrates a back isometric view of a portion of a door assembly.
Figure 14:
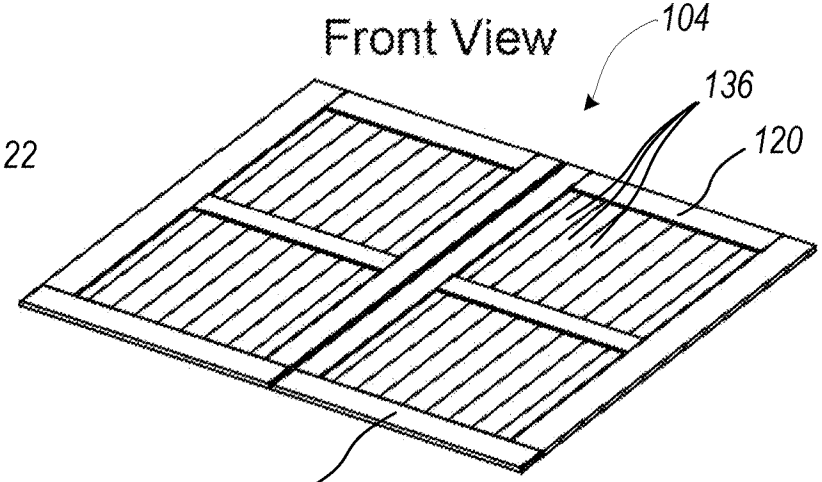
FIG. 14 illustrates a front isometric view of a portion of a door assembly.

FIG. 11 illustrates a front isometric view of a panel 136 of the door assembly 100. FIG. 12 illustrates a back isometric view of a portion of the façade layer 104 of the door assembly 100. FIG. 13 illustrates a back isometric view of a portion of the façade layer 104 door assembly 100. FIG. 14 illustrates a front isometric view of a portion of the façade layer 104 of the door assembly 100. FIGS. 11-14 are discussed together below.

The façade layer 104 can be consistent with the façade layer 104 discussed above; further details are discussed below with respect to FIGS. 11-14. For example, FIG. 11 shows the panel 136, which can include a tongue 137 and a groove 139. As shown in FIG. 12, the assembled frame segments can include the rabbeted joints 122, which can be configured to receive the panels 136 on a back side of the core layer 104.

The panels 136 can be configured to interlock through the tongue 137 and grooves 139 of the panels 136. That is, the panels 136 can interlock with each other via the tongue 137 and groove 139 of adjacent panels 136 when the panels 136 are positioned on the rabbet joints 122 between the frame segments 119 until the openings between frame segments 119 are filled, as shown in FIG. 14. In some examples, the panels 136 can be adhered (e.g., glued) or fastened (e.g., nailed or stapled) to the frame segments 119 or to each other.

The segments 119 or the panels 136 can include a polymer-capped surface that can be sanded off. For example, the polymer cap can be sanded using a wide belt sander, such as by making multiple passes, such as 1, 2, 3, 4, or the like. Sand paper, such as 50, 80, 120, or 220 grit sand paper can be used in order to create a surface that will allow the segments 119 or the panels 136 to adhere to the core layer 102.

Figure 15:
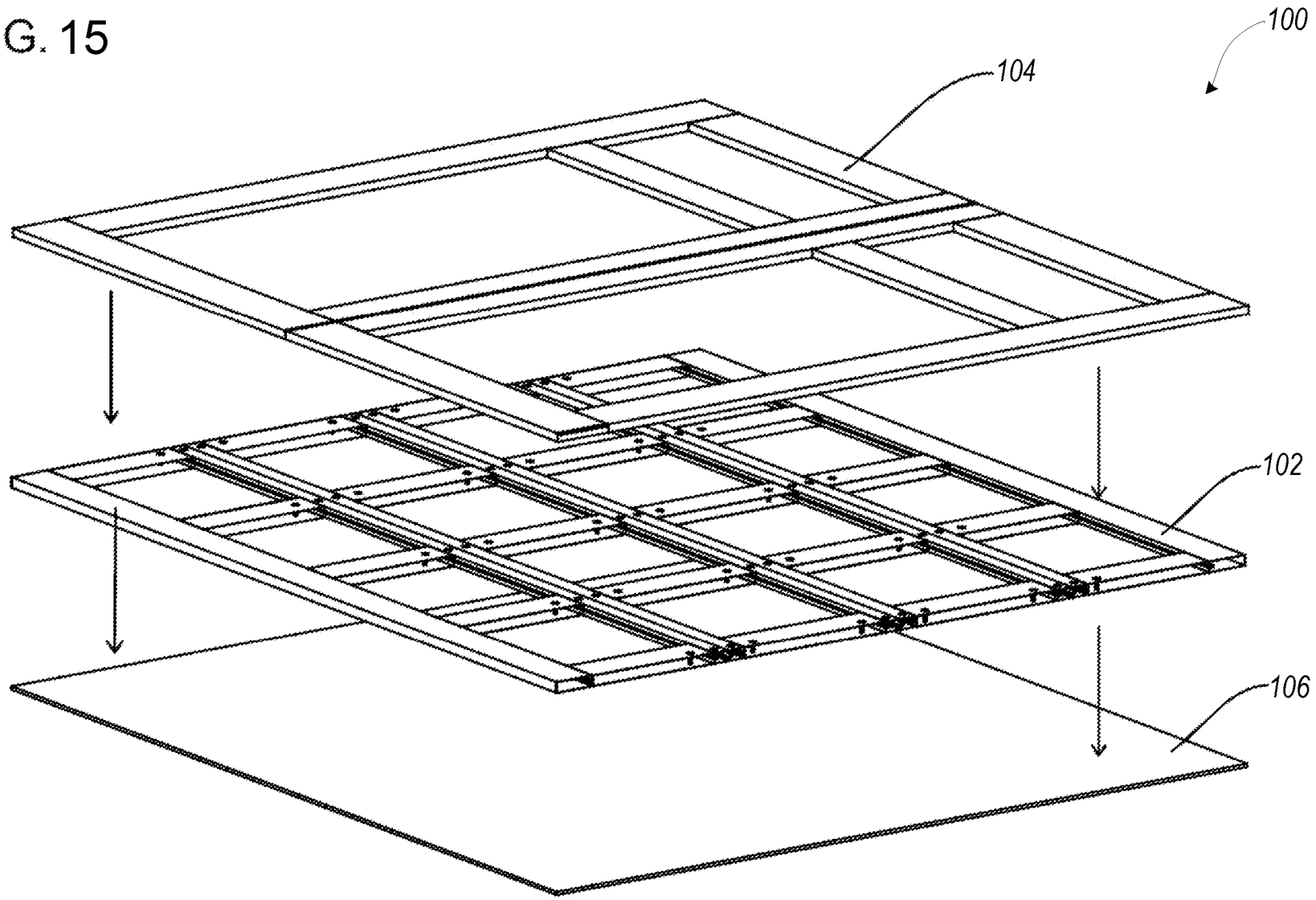
FIG. 15 illustrates an exploded isometric view of a portion of a door assembly.
Figures 16, 17:
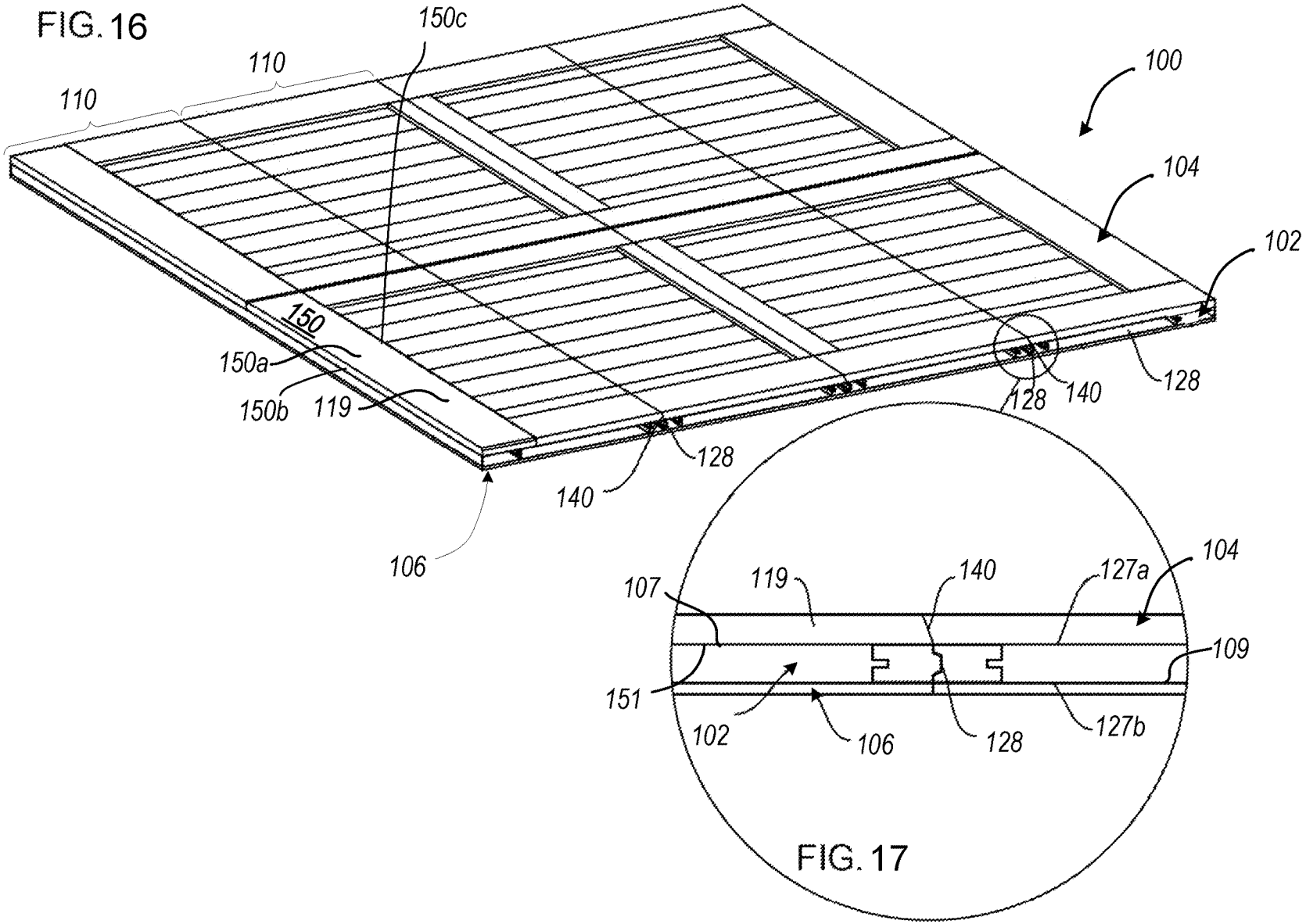
FIG. 16 illustrates a front isometric view of a door assembly.
FIG. 17 illustrates a focused end view of a portion of a door assembly.

FIG. 15 illustrates an exploded isometric view of a portion of the door assembly 100. FIG. 16 illustrates a front isometric view of the door assembly 100. FIG. 17 illustrates a focused end view of a portion of the door assembly 100. FIGS. 15-17 are discussed together below.

FIG. 15 shows the door assembly 100 prior to assembly of the façade layer 104 (without the panels 136), the core layer 102 (without the insulation 116), and a backing layer 106. FIG. 16 shows the layers assembled. When assembled, the façade layer 104 can define all or most of an exterior surface of the door 100. The backing layer 106 can form an inner surface of the door assembly 100. The backing layer 106 can be a rigid or semi-rigid component made of one or more of metals, plastics, foams, elastomers, ceramics, composites, combinations thereof, or the like. In some examples, the backing layer 106 can be made of a polymer-capped PVC between 5 and 15 millimeters in thickness. In some examples, the backing layer 106 can be about 9.5 millimeters (0.375 inches) in thickness. The backing layer 106 can be made of multiple components or can be a single sheet that is cut into sections.

During assembly, adhesive can be applied at a first seam 127*a* between the façade layer 104 and the core layer 102 and adhesive can be applied at a second seam 127*b* between the core layer 102 and the backing layer 106. That is, adhesive can be applied between the mating surface 151 of the façade layer 104 and the façade side 107 of the core layer 102 at the first seam 127*a*. Adhesive can also be applied between the backing layer 106 and the back side 109 of the core layer at the second seam 127*b*. Once adhered, the adhesive of the seams 127 can be cured, dried, bonded, or the like. In some examples, the façade layer 104, the core layer 102, and the backing layer 106 can be pressed together. For example, the layers can be vacuum pressed for an extended duration such as 2, 4, 6, 8, 10, 12, 14, 16, 18, 20, 22, 24, 28 hours, or the like.

As shown in FIGS. 16-17, the door assembly 100 can be cut back into horizontal sections 110 at seams 128 and 140. The seams 140 of the façade layer 104 can be cut through the façade layer 104 at a downward angle to help promote water runoff or runout from the door assembly 100. The angle of the seam 140 can be 5, 6, 7, 8, 9, 10, 11, 12, 13, 14, 15, 16, 17, 18, 19, or 20 degrees, or the like. The completed garage door 100 sections are then ready for re-assembly at a garage door installation site.

As discussed in FIGS. 3-5, hardware can be used for installing the garage door assembly 100 at an installation site. For example, 6.35 millimeter (standard 0.25 inch-20) flanged bolts can be threaded into the T-Nuts 118.

Because the façade layer 104 is adhered to the core layer 102, there is no need for fasteners (such as screws, nails, or staples) to extend through the external surface 150 of the façade layer. That is, the outer surface 150 of the frame segments 119 can have a continuous surface. For example, the sides 150*a*, 150*b*, and 150*c* of the outer surface 150 of the frame segments 119 can have a continuous surface. The door assembly 100 can thereby provide an exterior surface having an appearance of wood but using external materials of the façade layer 104 (such as polymers) helps to provide protection from erosion and, which, in turn, helps to reduce maintenance costs and efforts.

FIGS. 18-26 generally show steps for forming an exterior pre-hung door 200 that can include a polymer capped PVC façade layer 204 that can be adhered to an insulated core layer 202 without the need for any type of mechanical fasteners. The core layer 204 can be further adhered to a backing layer 206, as discussed in further detail below.

Figures 18, 19, 20:
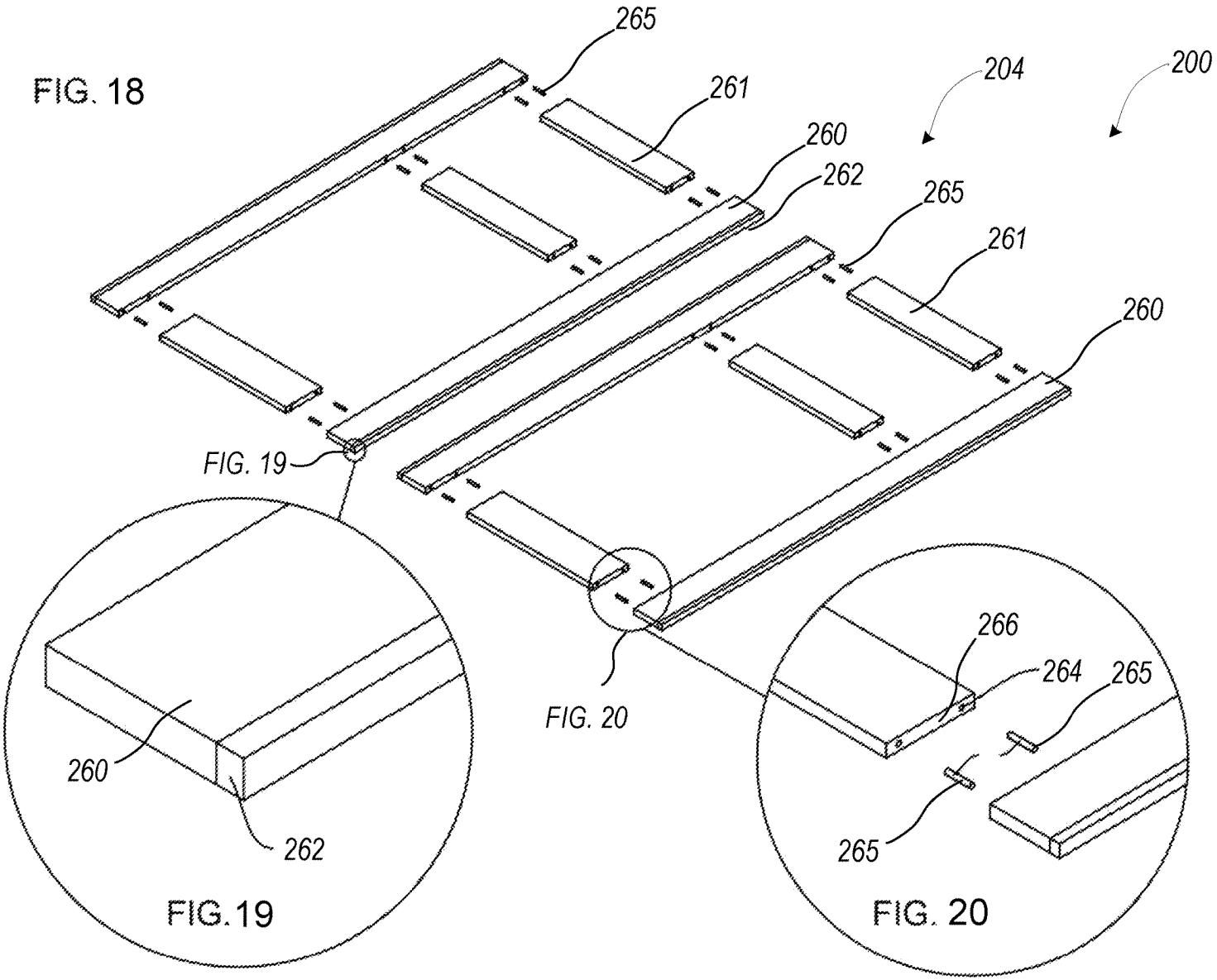
FIG. 18 illustrates a front isometric view of a portion of a door assembly.
FIG. 19 illustrates a focused isometric view of a portion of a door assembly.
FIG. 20 illustrates a focused isometric view of a portion of a door assembly.
Figure 21:
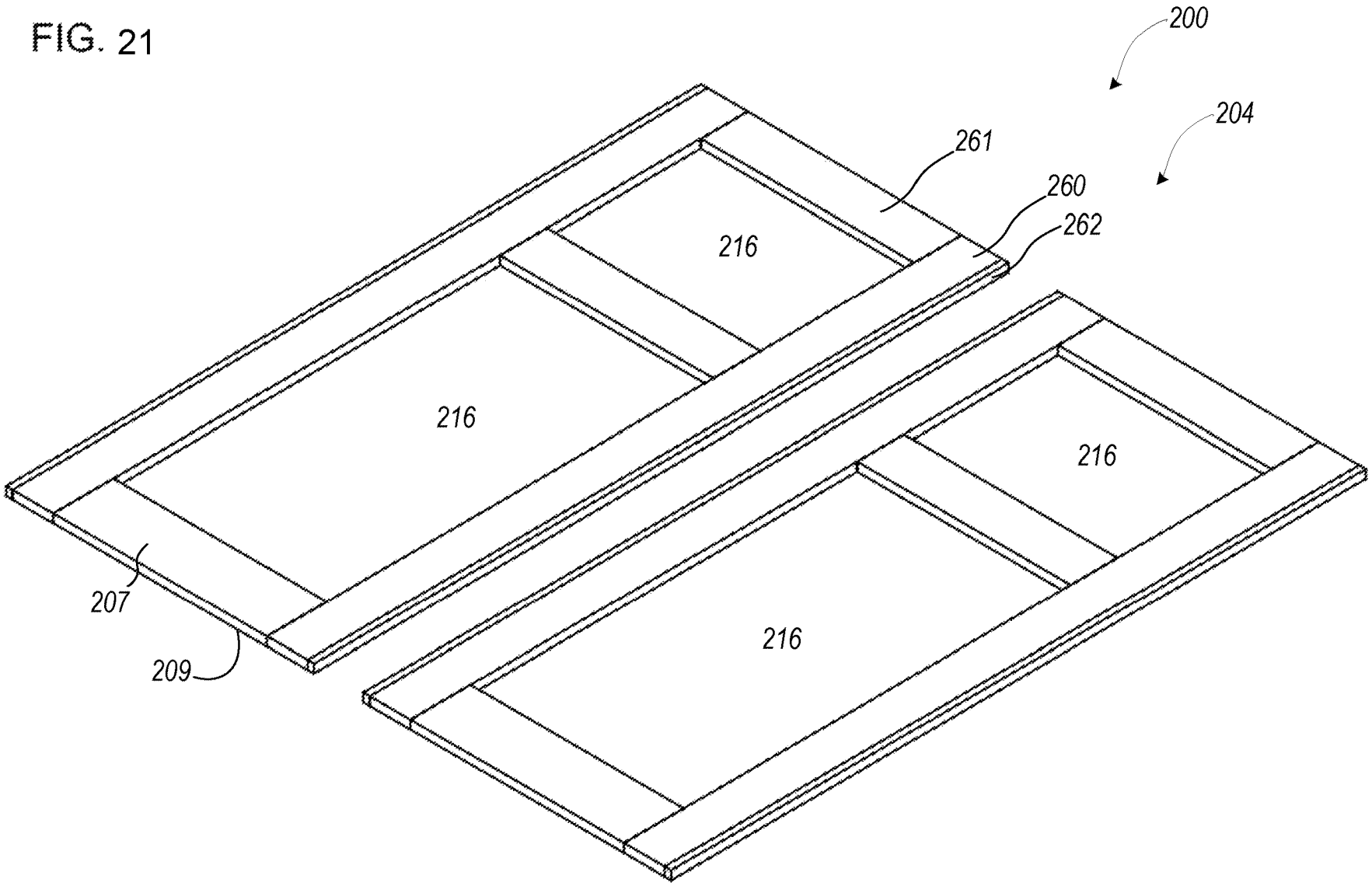
FIG. 21 illustrates a front isometric view of a portion of a door assembly.

FIG. 18 illustrates a front isometric view of a portion of a door assembly 200. FIG. 19 illustrates a focused isometric view of a portion of the door assembly 200. FIG. 20 illustrates a focused isometric view of a portion of the door assembly 200. FIG. 21 illustrates a front isometric view of a portion of the door assembly 200. FIGS. 18-21 are discussed together below.

FIG. 18 shows the core layer 204 which can include rails 261 and stiles 260. The rails 261 and stiles 260 can be made of wood (e.g., a lauan sheet good), foams, metals, or the like. In some examples, the rails 261 and stiles 260 can be made of laminated veneer lumber (LVL). The rails 261 and stiles 260 can have a thickness of between 10 millimeters and 60 millimeters. The rails and stiles can be about 44.45 millimeters (1.75") in thickness in some examples.

The rails 261 and stiles 260 can be cut to a desired length prior to assembly. As shown in FIG. 20, bores 264 can be created in ends 266 of the rails 261 and can be similarly created in edges of the stiles 260. The bores 264 can be configured to receive fasteners 265. The fasteners 265 can be wooden dowels, but can be other fasteners in other examples. In some examples, the bores 264 can be configured to accept fasteners 265, such as wooden dowels between 5 and 20 millimeters in diameter and between 25 and 100 millimeters in length. For example, the dowels can be about 9.5 millimeters (0.375 inches) in diameter and about 50.8 millimeters (2 inches) in length.

During assembly, the rails 261 and stiles 260 can be adhered to each other using glue or other adhesive. A strip 262 can be adhered to the stiles 260, as shown in FIG. 19. The strip 262 can be polymer-capped PVC material, or can be other polymeric materials. In other examples, the strip 262 can be made of wood or wood composite materials. The fasteners 265 can be inserted into the bores 264 and can be optionally adhered to the rails 261 and the stiles 260 to form the core layer 204. The strips 262, rails 261, and stiles 260 can be clamped to each other during curing or drying of the adhesive or glue. Insulation 216 can be positioned in between the openings formed by the rails 261 and stiles 260. The insulation 216 can be fiberglass, polystyrene, polyisocyanurate, or the like.

When the core layer 204 is formed, as shown in FIG. 21, the core layer can define a façade side 207 configured to be secured to the façade layer 204, and a back side 209 configured to be secured to the backing layer 206.

Figure 22:
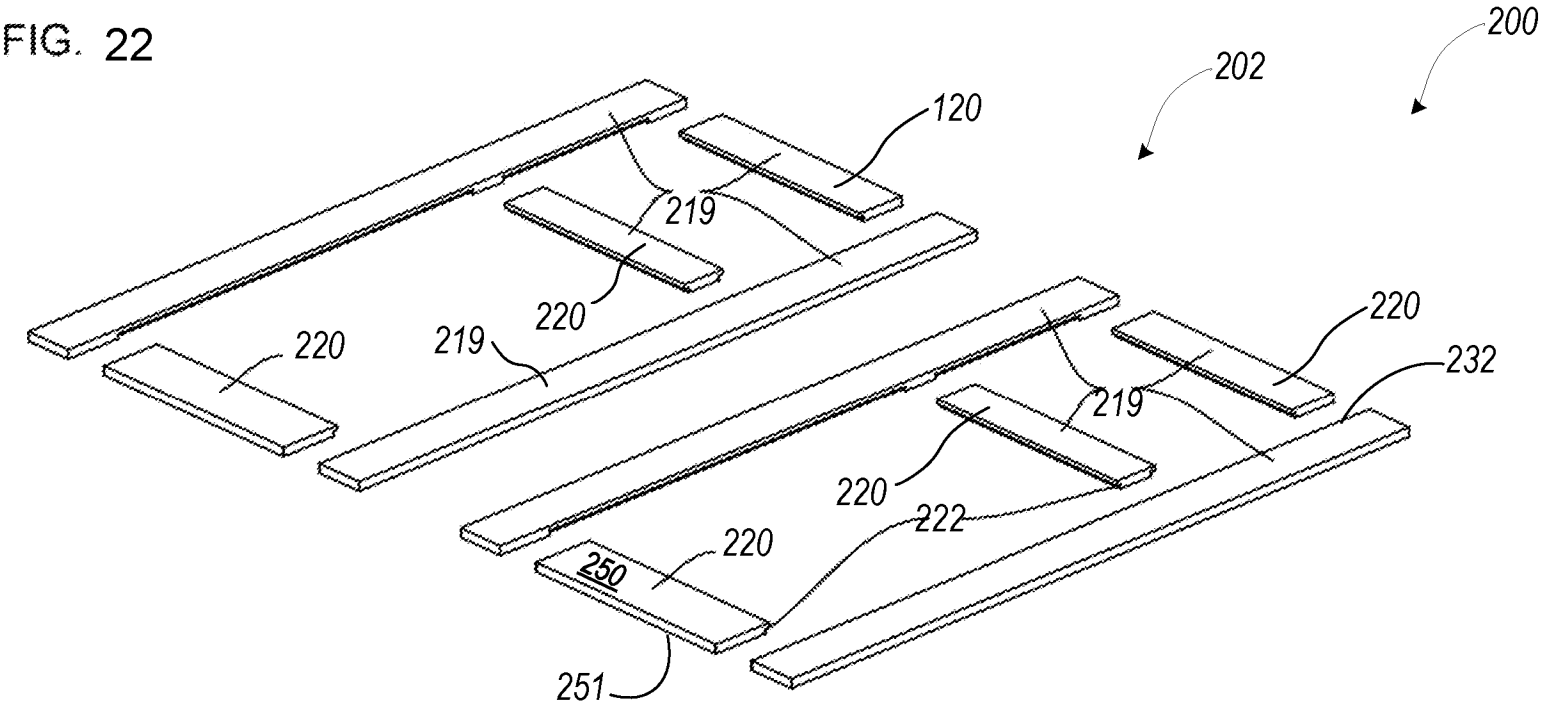
FIG. 22 illustrates a front isometric view of a portion of a door assembly.
Figure 24:
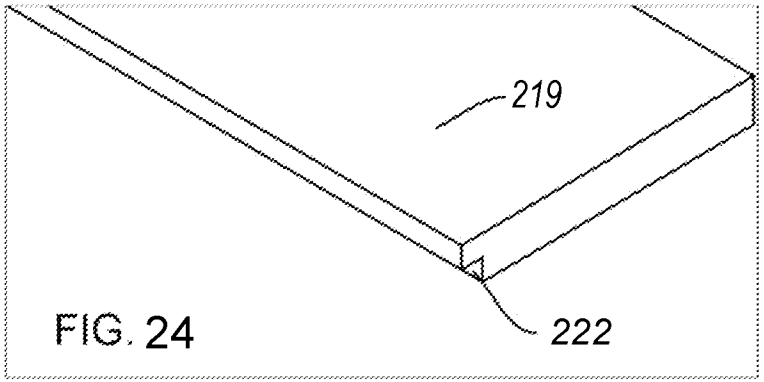
FIG. 24 illustrates a focused isometric view of a portion of a door assembly.
Figure 23:
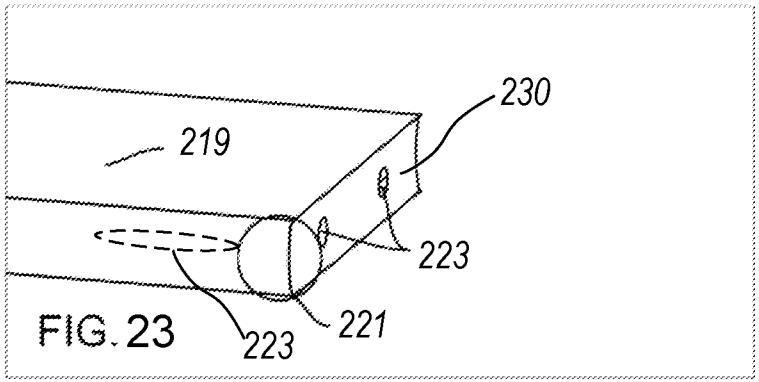
FIG. 23 illustrates a focused isometric view of a portion of a door assembly.

FIG. 22 illustrates a front isometric view of a portion of the door assembly 200. FIG. 23 illustrates a focused isometric view of a portion of the door assembly 200. FIG. 24 illustrates a focused isometric view of a portion of the door assembly 200. FIGS. 22-24 show the façade layer 204 of the door assembly 200 and are discussed below together.

The façade layer 204 can include a plurality of frame segments 219 defining an outer surface 250 and a mating surface 251. The outer surface 250 can be comprised of polymer which can surround a core 252 of the frame segments 219. In some examples, the frame segments 219 can be made of polymer-capped PVC. The core 252 can be made of various types of polymers. In some examples, the core 252 can be made of PVC.

In some examples, the polymer outer surface 250 can be removed from the core 252 to create the mating surface 251. That is, the polymer-cap surface can be removed from one side of the frame segments 219, such as by a sanding, scraping, planning, or other material removal process. Removal of the polymer cap can help to allow the mating surface 251 adhere to the core layer. In some examples, the frame segments can be un-capped and the core 252 can define the mating surface 251 such that removal of the polymer cap is not required.

FIG. 22 shows how the frame segments 219 can be positioned to form or develop frames within the façade layer 204. The frame segments 219 can include rail members 220, which can be cut to a required length and can be positioned between vertical frame segments 219.

The frame segments 219 can also include rabbeted edges 222 that can face substantially inward to receive and support paneling, as discussed below with respect to FIGS. 27-30. The rabbeted edges 222 are shown more clearly in FIG. 24 and can be substantially L-shaped. Other joint types can be used such as dovetails, fingers, mortise and tenon, or the like.

As shown in FIG. 23, ends of the frame segments 219, such as an end 230, can be shaped to have an interface configured to engage an edge portion 232 of any other of the frame segments 219. The ends 230 can be shaped or machined such as by using a routing or cutting or material removal process.

The end 230 can be machined to define an arcuate shape. The arcuate shape of the end 230 can be concave and the arcuate shape of the edge 232 can be convex such that the edge 232 end 230 and the edge 232 are complementary and configured to mate. Such a shape of the end 230 can help to simplify assembly because manufacturers of polymer boards often provide an edge (such as the edge 232) with a convex shape. The end 230 allows for mating with a convex (or factory) edge to obtain a tight fit between the frame segments without using custom materials, which can help to reduce manufacturing costs.

The frame segments 219 can also include pocket holes 223 extending through the outer surface 250 of the frame segment 219 (such as through the mating surface 251) that is optionally not visible following securing of the façade layer 204 to the core layer 202, such as when the mating surface 251 is adhered to the façade side 207 of the core layer 202. The pocket holes 223 can extend through (or at least partially through) the frame segments 219 and can extend out the end 230 of the frame segments 219. The pocket holes 223 can be configured to receive a fastener therein or therethrough, as discussed with regard to FIG. 26 below.

Figures 25, 26:
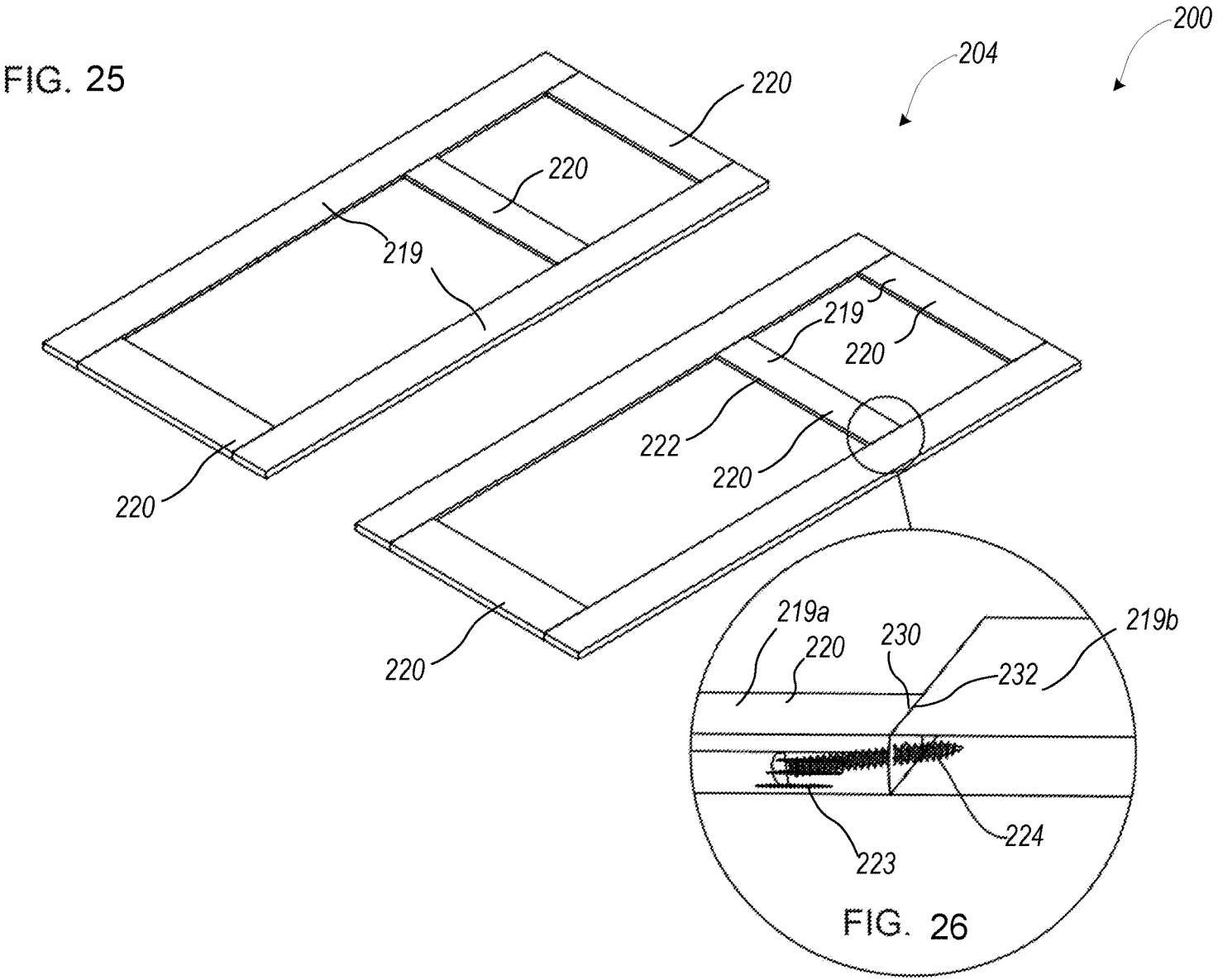
FIG. 25 illustrates a front isometric view of a portion of a door assembly.
FIG. 26 illustrates a focused isometric view of a portion of a door assembly.

FIG. 25 illustrates a front isometric view of a portion of the door assembly 200. FIG. 26 illustrates a focused isometric view of a portion of the door assembly 200. FIGS. 25 and 26 are discussed together below.

The door assembly 200 of FIGS. 25 and 26 can be consistent with the door assembly 200 discussed above with respect to FIGS. 18-24; FIGS. 25 and 26 show the façade layer 204 after the frame segments 219 are secured to each other, such as by using fasteners 239 through the pocket holes 223 of a first frame segment 219*a* and into a second frame segment 219*b* until the end 230 of the first frame segment 219*a* engages the edge 232 of the second frame segment 219*b*. The frame segments 219 can be similarly joined.

Figure 27:
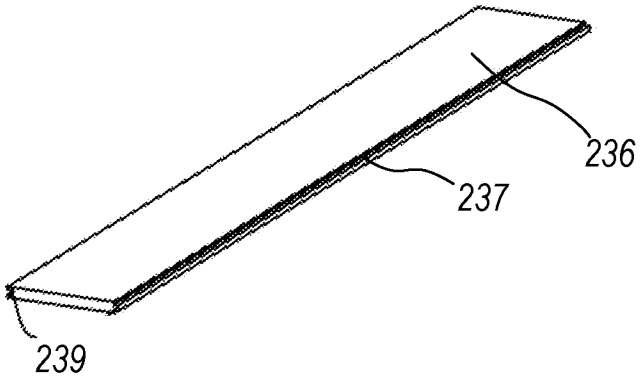
FIG. 27 illustrates a front isometric view of a portion of a door assembly.
Figure 28:
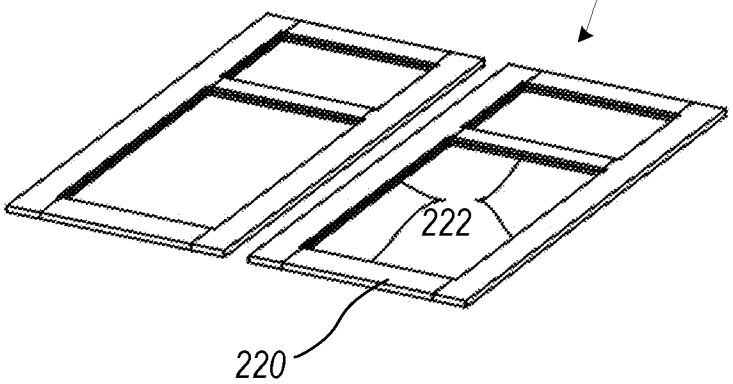
FIG. 28 illustrates a back isometric view of a portion of a door assembly.
Figure 29:
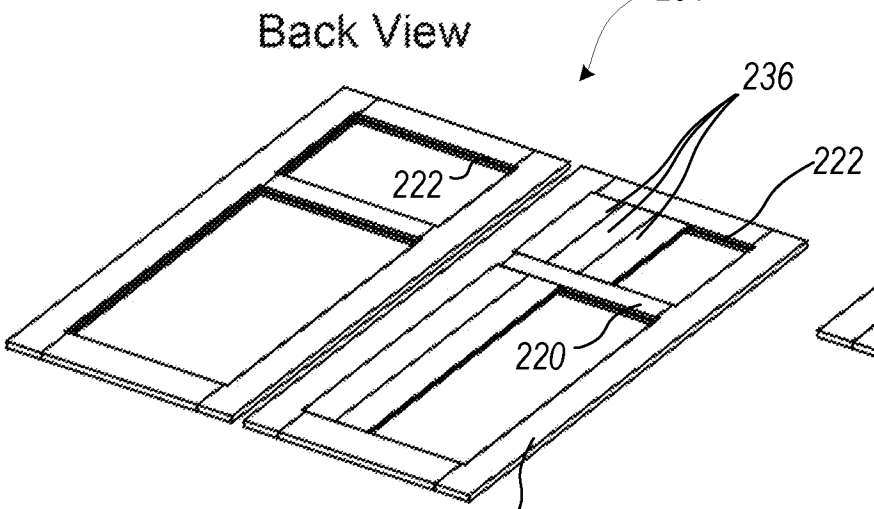
FIG. 29 illustrates a back isometric view of a portion of a door assembly.
Figure 30:
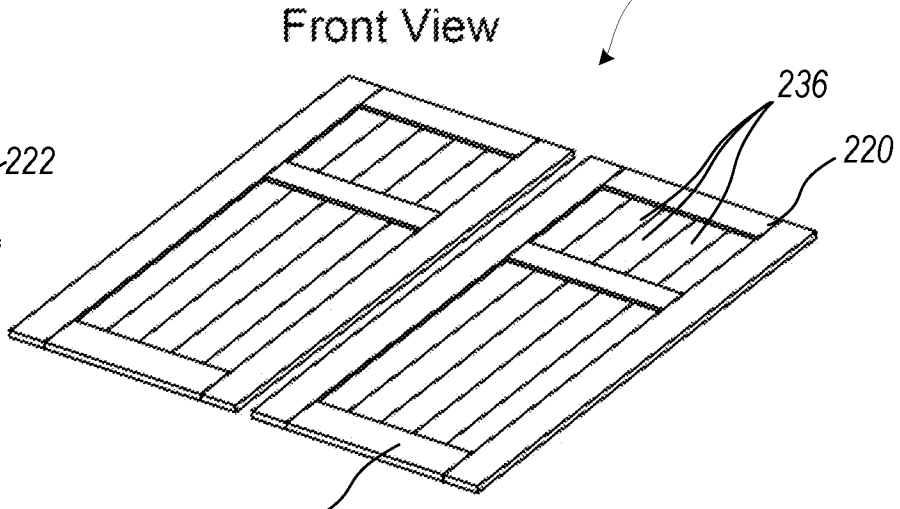
FIG. 30 illustrates a front isometric view of a portion of a door assembly.

FIG. 27 illustrates a front isometric view of a panel 236 of the door assembly 200. FIG. 28 illustrates a back isometric view of a portion the façade layer 204 of the door assembly 200. FIG. 29 illustrates a back isometric view of a portion of the façade layer 204 door assembly 200. FIG. 30 illustrates a front isometric view of a portion of the façade layer 204 of the door assembly 100. FIGS. 27-30 are discussed together below.

The façade layer 204 can be consistent with the façade layer 204 discussed above; further details are discussed below with respect to FIGS. 27-30. For example, FIG. 27 shows the panel 236, which can include a tongue 237 and a groove 239. As shown in FIG. 28, the assembled frame segments 220 can include the rabbeted joints 222, which can be configured to receive the panels 236 on a back side of the façade layer 204.

The panels 236 can be configured to interlock through the tongue 237 and grooves 239 of the panels 236. That is, the panels 236 can interlock with each other via the tongue 237 and groove 239 of adjacent panels 236 when the panels 236 are positioned on the rabbet joints 222 between the frame segments 219 until the openings between frame segments 219 are filled, as shown in FIG. 30. In some examples, the panels 236 can be adhered (e.g., glued) or fastened (e.g., nailed or stapled) to the frame segments 219 or to each other.

The segments 219 or the panels 236 can include a polymer-capped surface that can be sanded off. For example, the polymer cap can be sanded using a wide belt sander, such as by making multiple passes, such as 1, 2, 3, 4, or the like. Sandpaper, such as 50, 80, 120, or 220 grit sandpaper can be used in order to create a surface that will allow the segments 219 or the panels 236 to adhere to the core layer 102.

Figure 31:
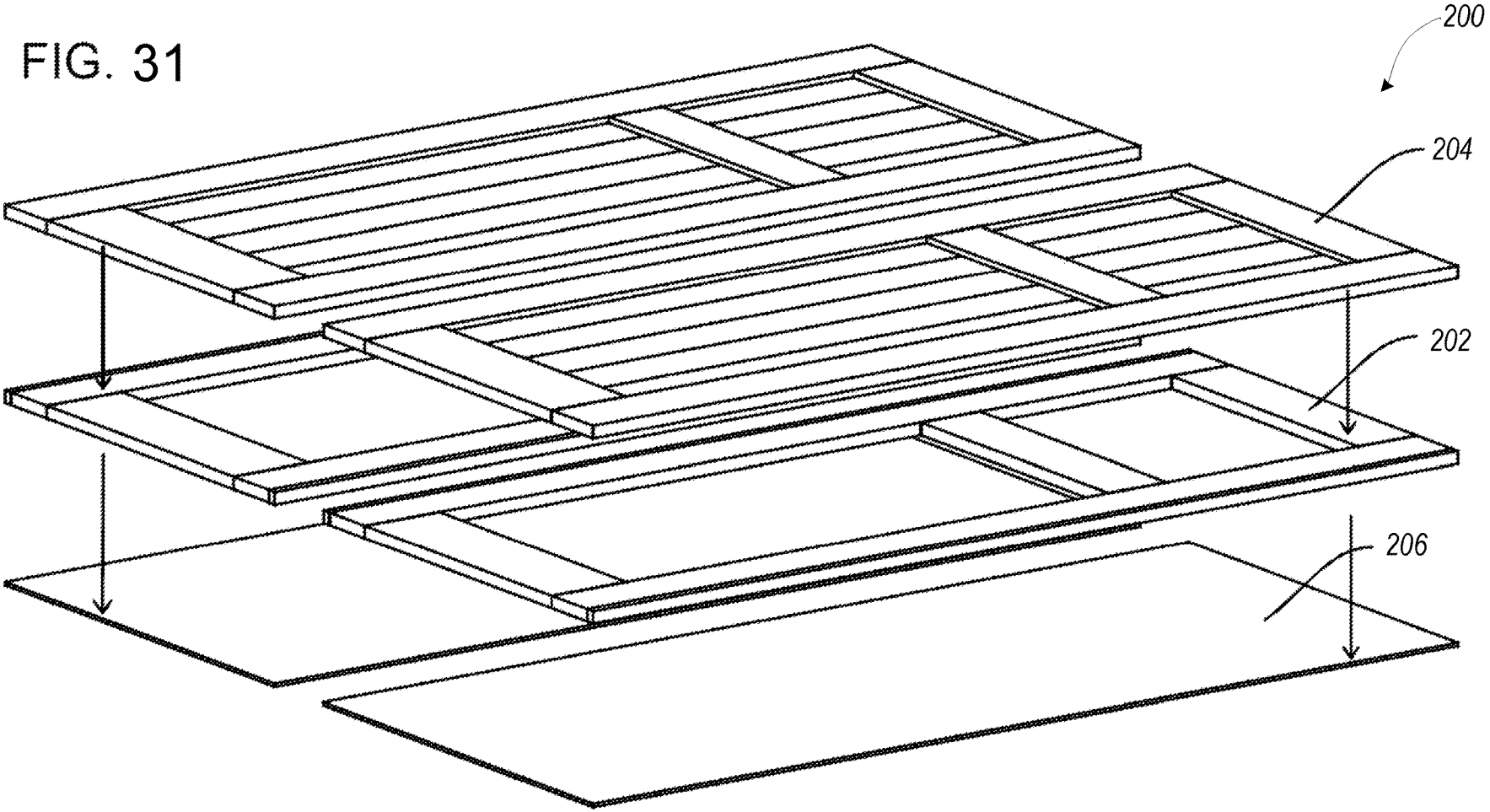
FIG. 31 illustrates an exploded isometric view of a door assembly.
Figure 32:
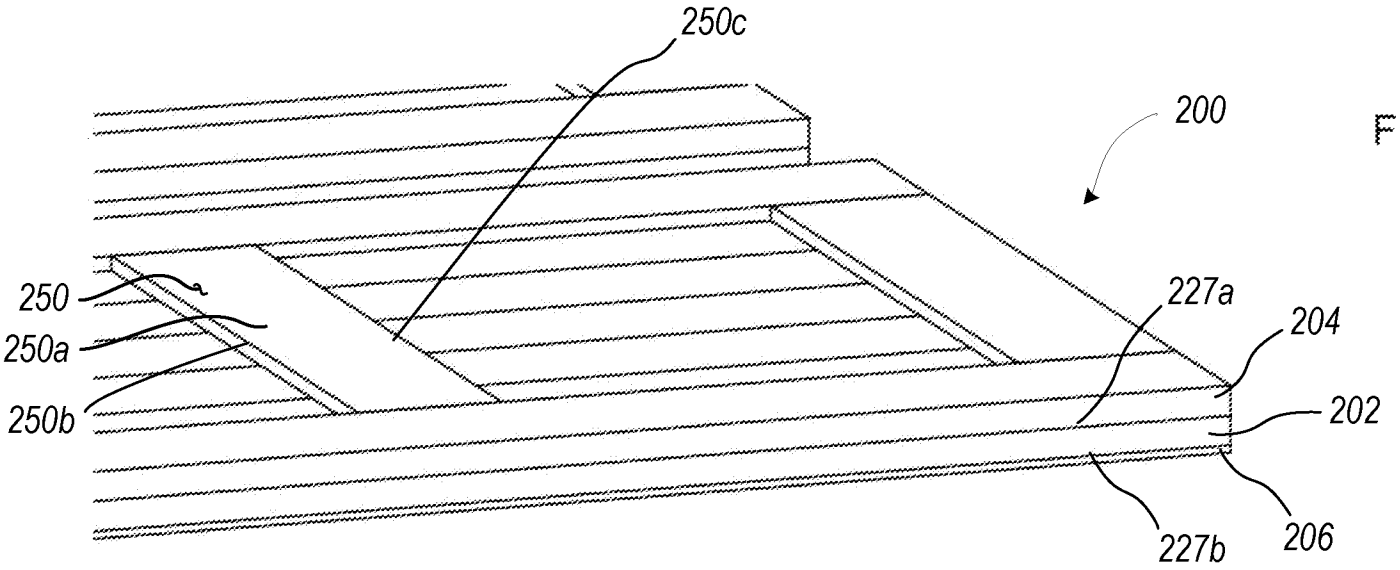
FIG. 32 illustrates a focused isometric view of a portion of a door assembly.

FIG. 31 illustrates an exploded isometric view of a portion of the door assembly 200 prior to assembly of the façade layer 204 (without the panels 136), the core layer 202 (without the insulation 216), and a backing layer 206. FIG. 32 illustrates a focused isometric view of a portion of a door assembly 200A.

During assembly, adhesive can be applied at a first seam 227*a* between the façade layer 204 and the core layer 202 and adhesive can be applied at a second seam 227*b* between the core layer 202 and the backing layer 206. That is, adhesive can be applied between the mating surface 251 of the façade layer 204 and the façade side 207 of the core layer 202 at the first seam 227*a*. Adhesive can also be applied between the backing layer 206 and the back side 209 of the core layer at the second seam 227*b*. Once adhered, the adhesive of the seams 227 can be cured, dried, bonded, or the like. In some examples, the façade layer 204, the core layer 202, and the backing layer 206 can be pressed together. For example, the layers can be vacuum pressed for an extended duration such as 2, 4, 6, 8, 10, 12, 14, 16, 18, 20, 22, 24, 28 hours, or the like.

FIG. 32 shows the layers assembled. When assembled, the façade layer 204 can define all or most of an exterior surface of the door 200. The backing layer 206 can form an inner surface of the door assembly 200. The backing layer 206 can be a rigid or semi-rigid component made of one or more of metals, plastics, foams, elastomers, ceramics, composites, combinations thereof, or the like. In some examples, the backing layer 206 can be made of a polymer-capped Polyvinyl Chloride between 5 and 15 millimeters in thickness. In some examples, the backing layer 206 can be about 9.5 millimeters (0.375 inches) in thickness.

Because the façade layer 204 is adhered to the core layer 202, there is no need for fasteners (such as screws, nails, or staples) to extend through the external surface 250 of the façade layer. That is, the outer surface 250 of the frame segments 219 can have a continuous surface. For example, the sides 250*a*, 250*b*, and 250*c* of the outer surface 250 of the frame segments 219 can have a continuous surface. The door assembly 200 can thereby provide an exterior surface having an appearance of wood but using external materials of the façade layer 204 (such as polymers) helps to provide protection from erosion, which, in turn, helps to reduce maintenance costs and efforts.

Figures 33, 34, 35:
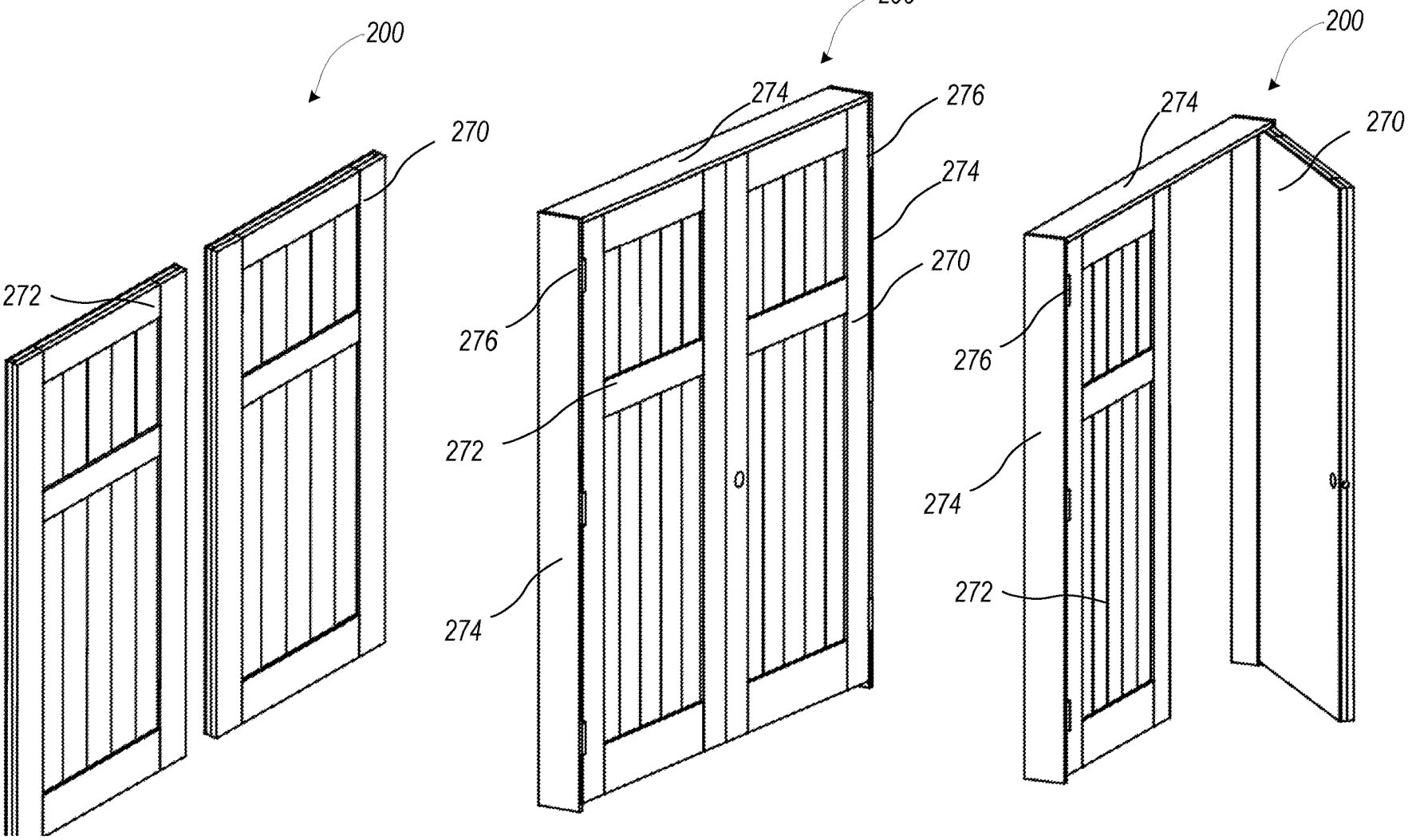
FIG. 33 illustrates a front isometric view of a portion of a door assembly.
FIG. 34 illustrates a front isometric view of a portion of a closed door assembly.
FIG. 35 illustrates a front isometric view of a portion of an open door assembly.

FIG. 33 illustrates a front isometric view of a portion of the door assembly 200. FIG. 34 illustrates a front isometric view of a portion of a closed-door assembly 200. FIG. 35 illustrates an exploded isometric view of a portion of an open-door assembly 200. FIGS. 33-35 are discussed together below.

Figures 36, 37:
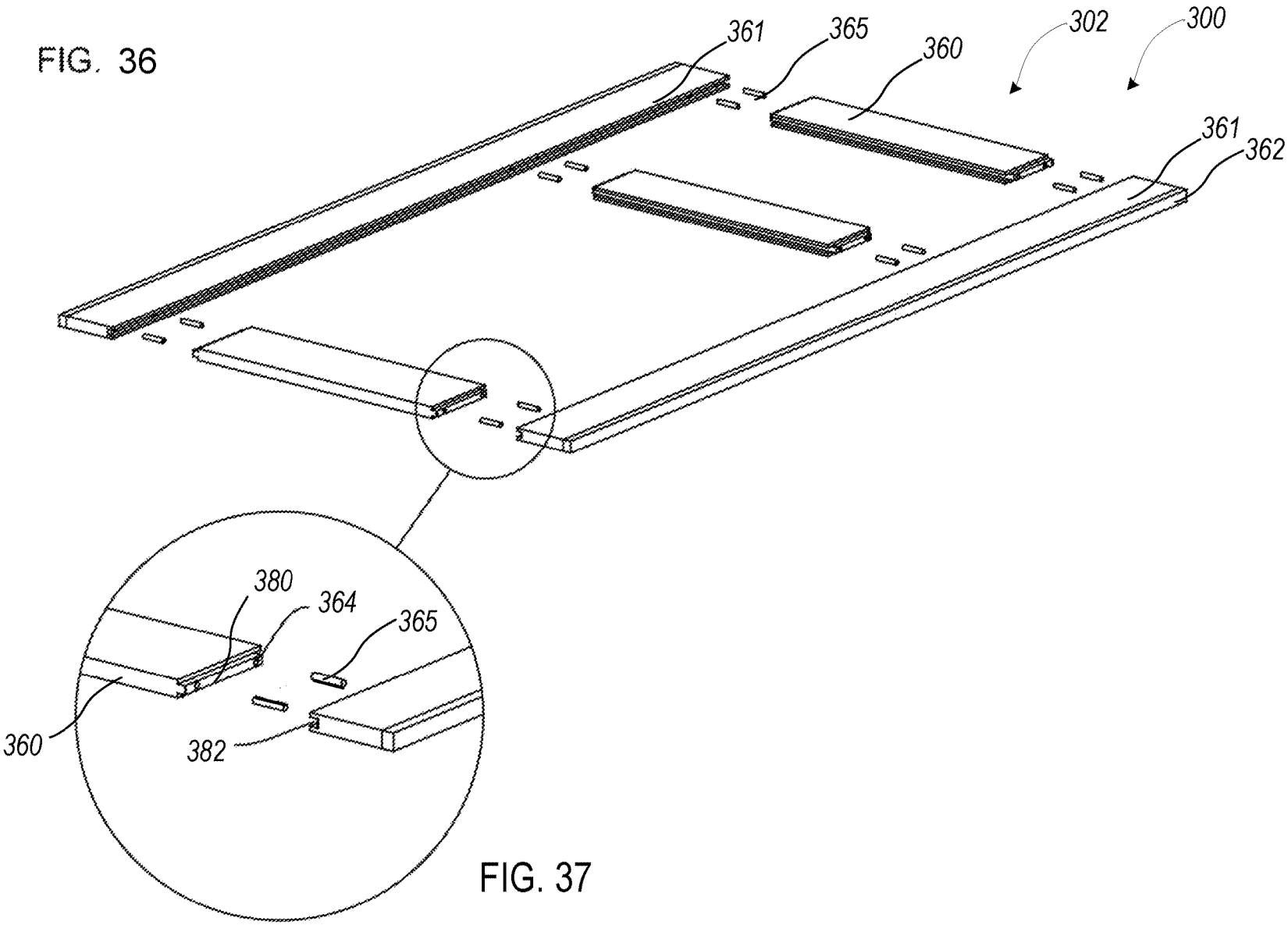
FIG. 36 illustrates a front isometric view of a portion of a door assembly.
FIG. 37 illustrates a focused isometric view of a portion of a door assembly.

The door assembly 200 (or 200A or 200B) can be provided where the doors 270 and 272 are made of the adhered layers discussed above. The doors 270 and 272 can then be secured to a jamb assembly 274 via hinges 276 which can allow the doors 270 and 272 to move from a closed position, as shown in FIG. 35, to an open position, as shown in FIG. 36 (door 270). The jamb assembly 274 can be comprised of non-wood materials in some examples such as a polymer-capped PVC or PVC.

Figure 38:
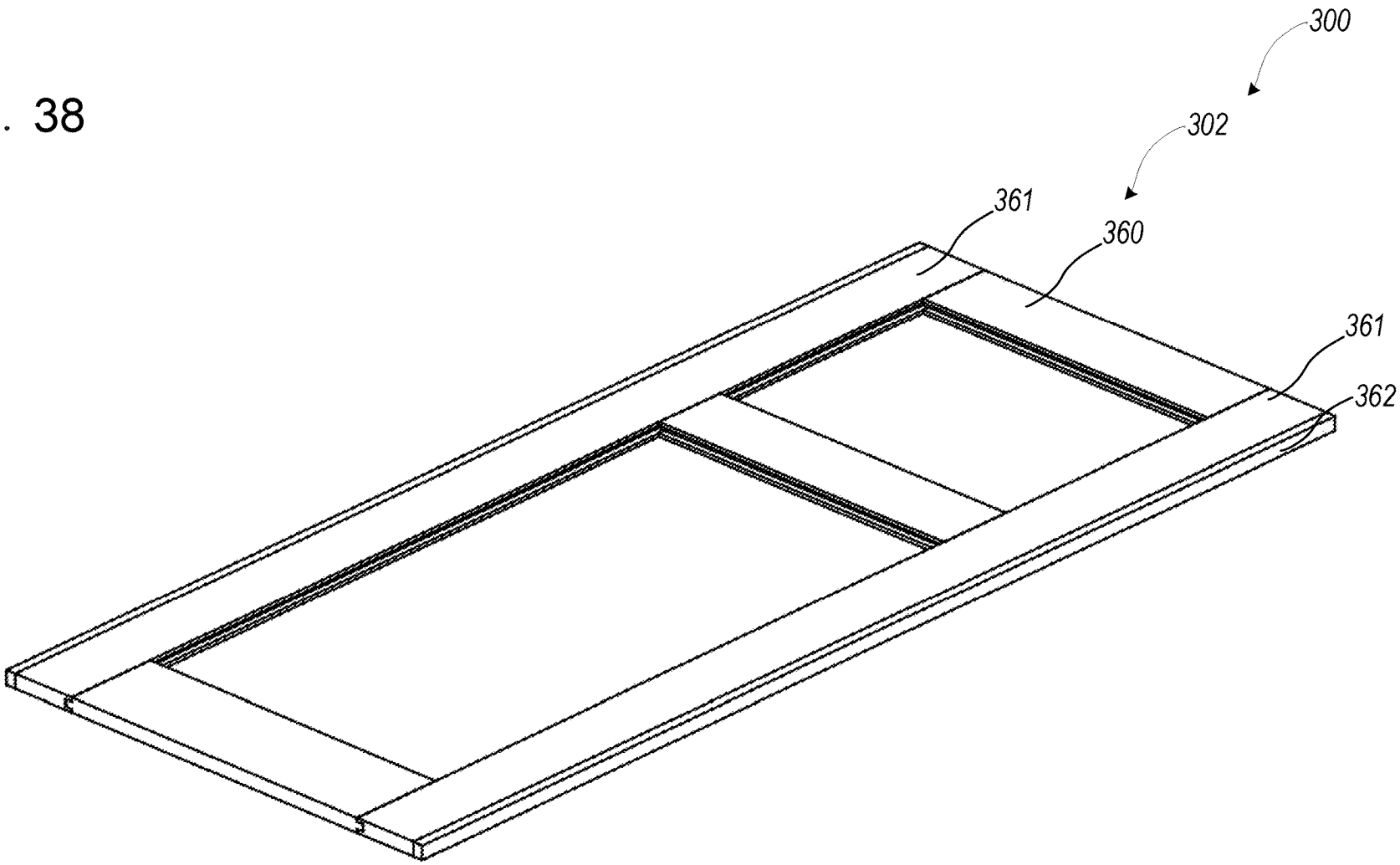
FIG. 38 illustrates a front isometric view of a portion of a door assembly.

FIG. 36 illustrates a front isometric view of a portion of a door assembly 300. FIG. 37 illustrates a focused isometric view of a portion of the door assembly 300. FIG. 38 illustrates a front isometric view of a portion of the door assembly 300. FIGS. 36-38 are discussed together below.

The door assembly 300 can include a core layer 302 that can be similar to the core layers 102 and 202 discussed above where like numerals can represent like components, such as rails 360, stiles 361, and strips 362. As shown more clearly in FIG. 37, in the core layer 302, the rails can include tongues 380 and the stiles 361 can include grooves 382.

During assembly of the core layer 302, fasteners 365 (such as dowels) can be inserted and adhered to bores 364 of the rails 360 and stiles 361 and the tongues 380 can be inserted into the grooves 382 where the tongues 380 can be adhered or fastened (e.g., stapled or nailed) to the stiles 361. FIG. 38 shows the core layer 302 following assembly thereof.

Figure 39:
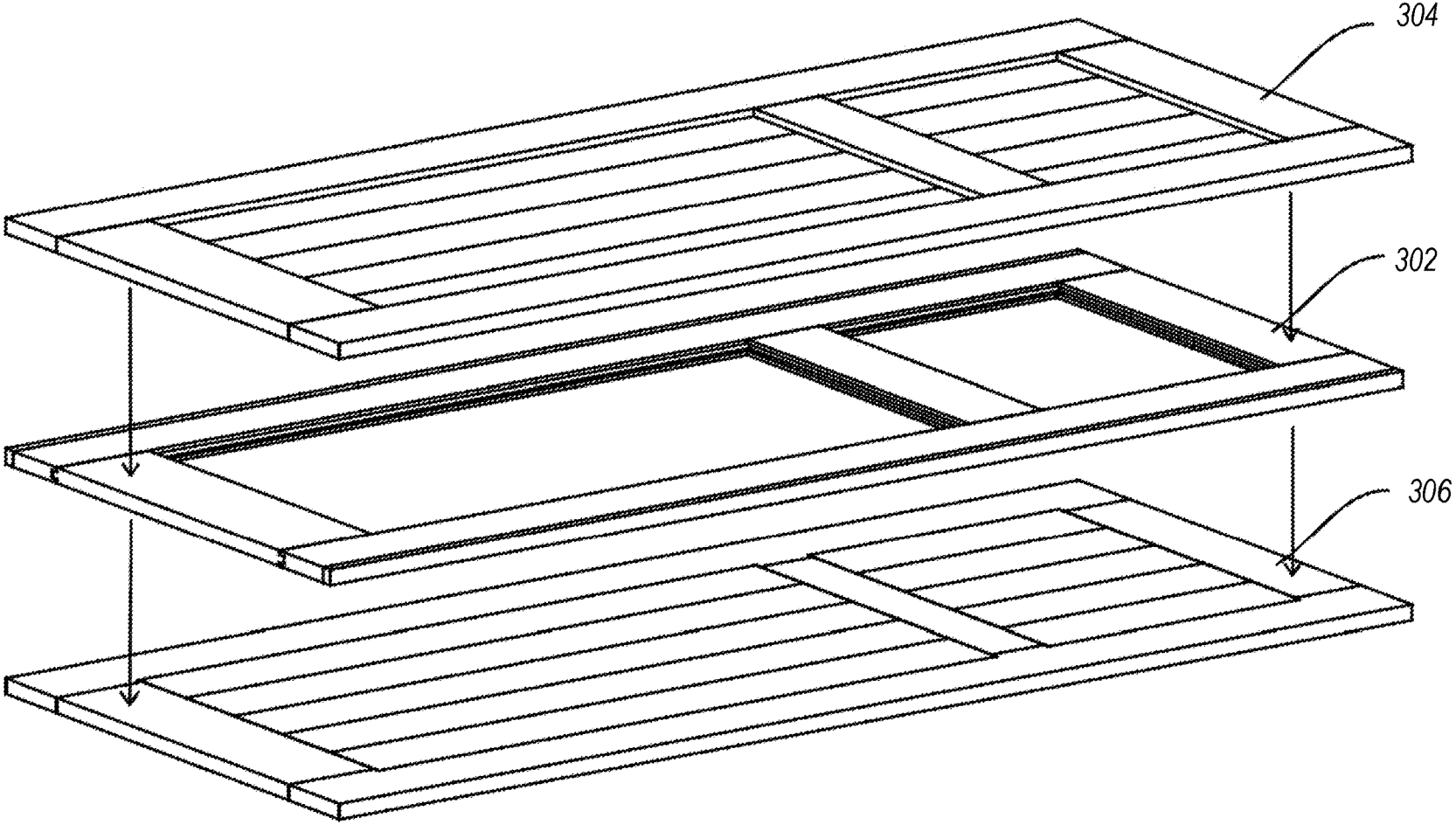
FIG. 39 illustrates an exploded isometric view of a door assembly.
Figure 40:
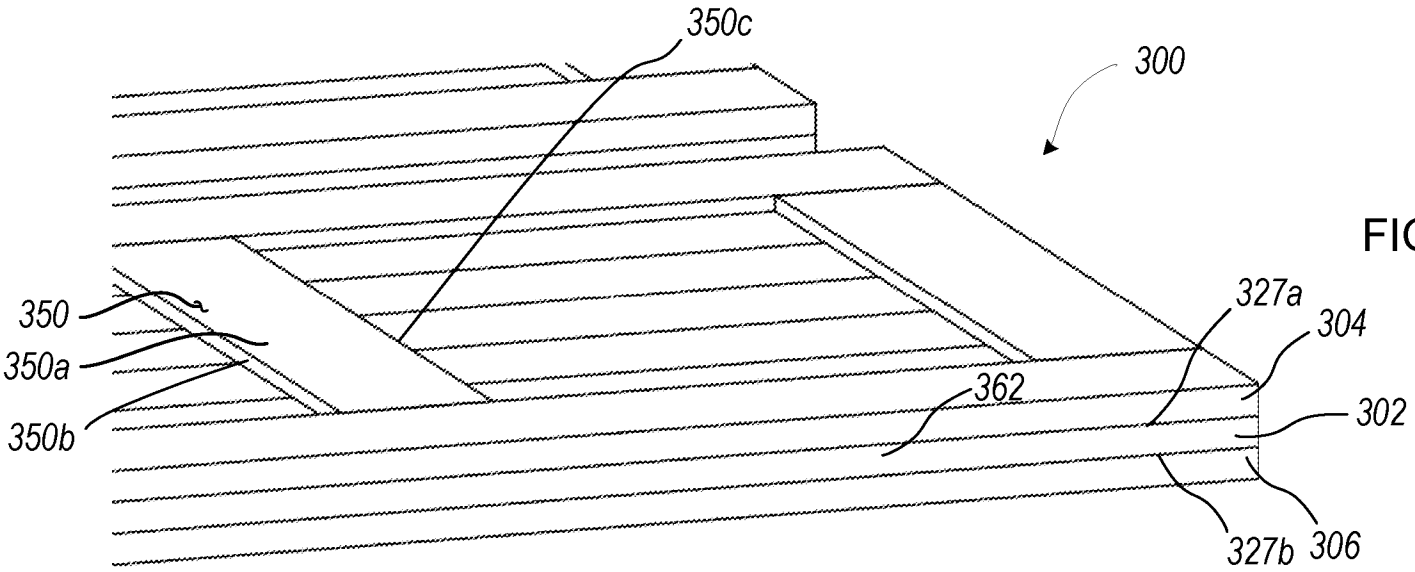
FIG. 40 illustrates a focused isometric view of a portion of a door assembly.

FIG. 39 illustrates an exploded isometric view of a door assembly where the core layer 302 can be adhered to the façade layer 304 and the backing layer 306. FIG. 40 illustrates a focused isometric view of a portion of the door assembly 300.

During assembly, adhesive can be applied at a first seam 327*a* between the façade layer 304 and the core layer 302 and adhesive can be applied at a second seam 327*b* between the core layer 302 and the backing layer 306, similar to the assemblies discussed above.

The backing layer 306 of the door assembly 300 can be a second façade layer. For example, the backing layer 306 can be the same as the façade layer 304 such that both sides of the door assembly appear the same and are made of the same materials, such as a polymer-capped PVC material. Such an assembly can provide a door that is erosion resistant on both sides. In examples where the strip 362 is included on the core layer 302, the front, back, and sides of the door assembly can be made of erosion resistant materials, which can be useful in caustic environments, such as an access door near a body of water (e.g., ocean or lake). In other examples, the backing layer 306 can be constructed and can appear the same as the façade layer 304, but the backing layer 306 can be made of wood or wood composites.

Figure 42:
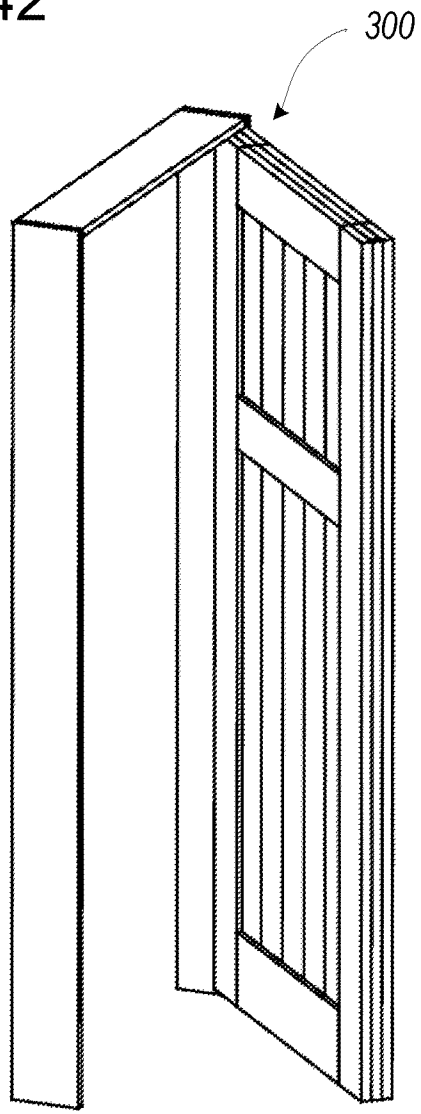
FIG. 42 illustrates a front isometric view of a portion of an open door assembly.
Figure 41:
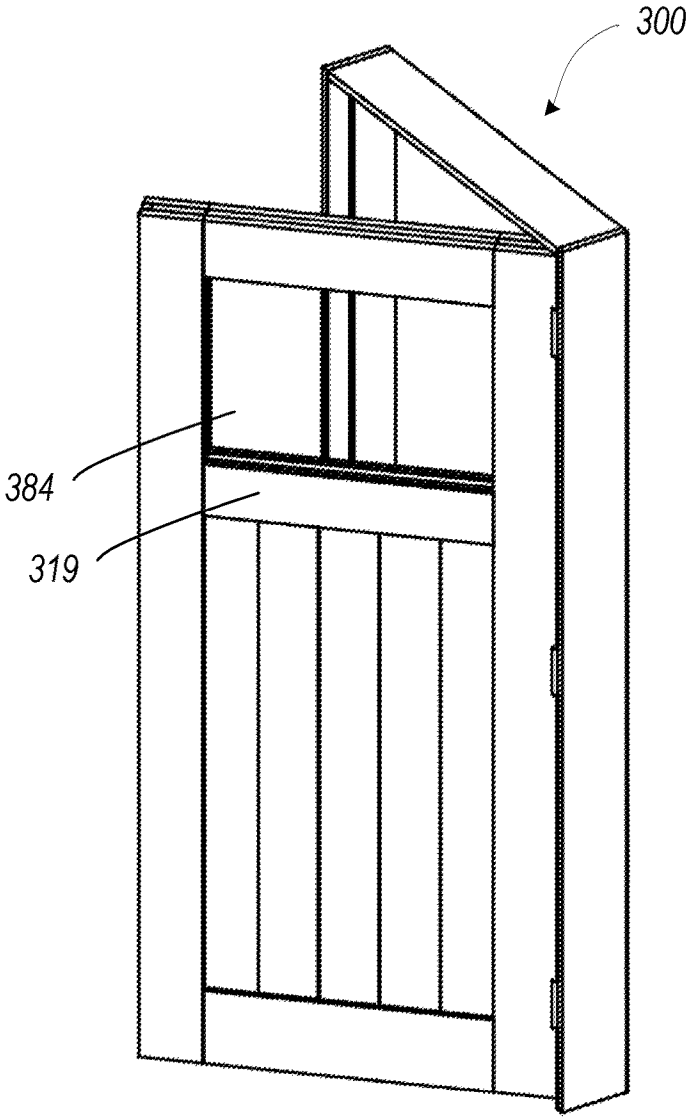
FIG. 41 illustrates a front isometric view of a portion of an open door assembly.

FIGS. 41 and 42 illustrate front isometric views of the door assembly 300 in an open position.

As shown in FIG. 41, a window 484 can be included. Such a window can be made of glass or other transparent materials such as an acrylic. The window 384 can be defined, at least in part, by frame members 319 of the façade layer 304 (and optionally of the backing layer 306) and portions of the core layer 302, which can together support and retain the window 384.

Figure 44:
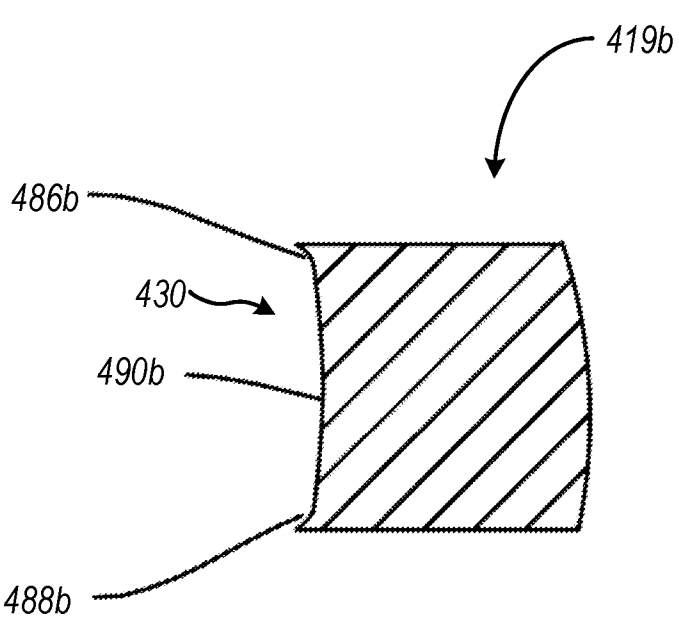
FIG. 44 illustrates a cross-section view of a portion of a door assembly.
Figure 43:
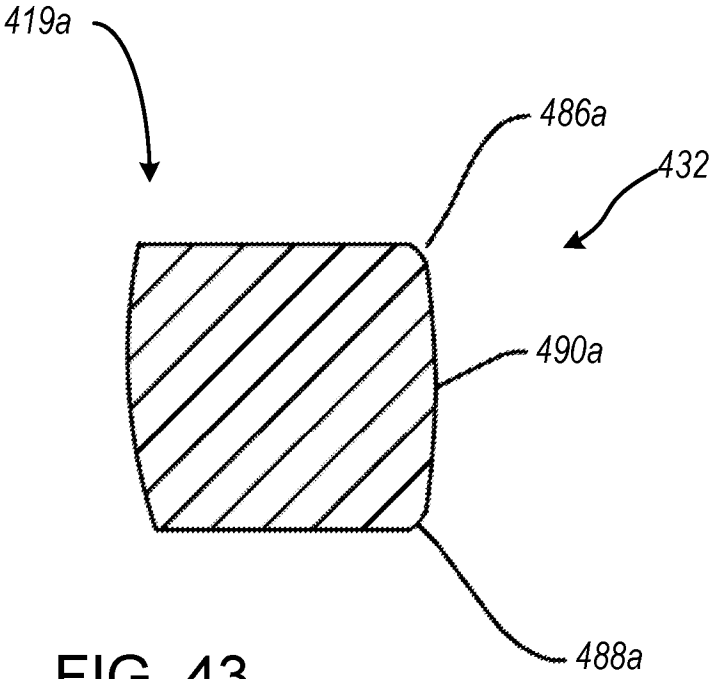
FIG. 43 illustrates a cross-section view of a portion of a door assembly.

FIG. 43 illustrates a cross-section view of a portion of a door assembly. FIG. 44 illustrates a cross-section view of a portion of a door assembly. FIGS. 43 and 44 are discussed together below.

FIG. 43 shows a frame member 419*a* and FIG. 44 shows a frame member 419*b*, where the frame members 419 can be similar to the frame members 119, 219, or 319 discussed above. The frame member 419*a* can include an edge 432, which can be a factory edge defining corners 486*a* and 488*a* and surface 490*a*. The frame member 419*b* can include end 430 which can include recesses 486*b* and 488*b* and surface 490*b*.

The end 430 can be machined (e.g., routed) such that the surface 490*b* and the recesses 486*b* and 488*b* can define an arcuate shape such as a concave arcuate shape. The edge 432 can be machined or can be provided with a factory edge such that the surface 490*a* and the corners 486*a* and 488*a* define an arcuate and convex shape. The end 430 can be configured such that it is complementary to and configured to mate with the edge 432. Such a shape of the end 430 can help to simplify assembly because manufacturers of polymer boards often provide an edge (such as the edge 432) with a convex shape. The end 430 allows for mating with a convex (or factory) edge to obtain a tight fit between the frame segments without using custom materials, which can help to reduce manufacturing costs.

The materials used for the façade layer (e.g., 104, 204, 304) and the backing layer (e.g., 106, 206, 306) can be made of polymer-capped PVC, as discussed above. These layers can also be made of other polymer products, such as composites of recycled wood or plastic fibers, PVC, or the like. In some examples, an AZEK polymer-capped PVC can be used. Products by AZEK are traditionally used in the decking. The invention steps described above can use similar polymer-capped PVC material designed for decking and can form an exterior door that resembles real wood, can help to reduce yearly maintenance, and can be provided with a 50-year stain and fade warranty. Moreover, this polymer-capped PVC material is available in numerous colors, sizes and design options so that the exterior doors can be provided with a custom-made look that can be selected by homeowners.

NOTES AND EXAMPLES

The following, non-limiting examples, detail certain aspects of the present subject matter to solve the challenges and provide the benefits discussed herein, among others.

Example 1 is a door assembly comprising: a core layer defining a façade side and a back side opposite the façade side, the core layer comprising: a rail; and a plurality of stiles coupled to the rail; a backing layer adhered to the back side of the core layer; and a façade layer adhered to the façade side of the core layer, the façade layer comprising: a plurality of frame segments defining an outer surface comprised of polymer and the plurality of frame segments defining a mating surface adhered to the façade side of the core layer.

In Example 2, the subject matter of Example 1 optionally includes wherein the mating surface is made of Polyvinyl chloride.

In Example 3, the subject matter of Example 2 optionally includes wherein the plurality of frame segments include a core portion made of Polyvinyl Chloride, the core portion defining the mating surface.

In Example 4, the subject matter of Example 3 optionally includes wherein the plurality of frame segments of the façade layer include a pocket extending through the mating surface and configured to receive a screw to secure frame segments to each other.

In Example 5, the subject matter of any one or more of Examples 1-4 optionally include wherein the core layer is adhered to one or more of the façade layer and the backing layer using an adhesive.

In Example 6, the subject matter of Example 5 optionally includes wherein the core layer is adhered to one or more of the façade layer and the backing layer using a cold press operation.

In Example 7, the subject matter of any one or more of Examples 1-6 optionally include wherein each of the plurality of frame segments includes an end portion, at least one frame segment of the plurality of frame segments including an end portion having an interface configured to engage an edge portion of any other of the plurality of frame segments.

In Example 8, the subject matter of Example 7 optionally includes wherein the interface of the at least one end portion is arcuate and concave.

In Example 9, the subject matter of Example 8 optionally includes wherein the edge portions of at least one of the plurality of frame segments is arcuate and convex.

In Example 10, the subject matter of any one or more of Examples 1-9 optionally include wherein the façade layer comprises a plurality of panels located between the plurality of frame segments.

In Example 11, the subject matter of Example 10 optionally includes wherein the plurality of panels are adhered to the core layer.

In Example 12, the subject matter of any one or more of Examples 1-11 optionally include wherein the door is a garage door.

Example 13 is a door assembly comprising: a core layer defining a façade side and a back side opposite the façade side, the core layer comprising: a top rail; an intermediate rail; and a plurality of stiles coupled to the top rail and the intermediate rail a backing layer adhered to the back side of the core layer; and a façade layer adhered to the façade side of the core layer, the façade layer comprising: a plurality of frame segments defining an outer surface comprised of Polyvinyl chloride and the plurality of frame segments defining a mating surface adhered to the façade side of the core layer.

In Example 14, the subject matter of Example 13 optionally includes wherein the top rail, the intermediate rail, and the plurality of stiles form one or more spaces therebetween, the spaces filled with polystyrene insulation.

In Example 15, the subject matter of Example 14 optionally includes wherein the façade layer comprises a plurality of panels located between the plurality of frame segments.

In Example 16, the subject matter of Example 15 optionally includes wherein the plurality of panels are adhered to the core layer.

In Example 17, the subject matter of Example 16 optionally includes wherein the plurality of panels are adhered, at least in part, to the polystyrene insulation.

In Example 18, the subject matter of any one or more of Examples 13-17 optionally include wherein the door is an access door.

In Example 19, the subject matter of any one or more of Examples 13-18 optionally include wherein the plurality of stiles engage the rail to form a plurality of rabbet joints.

In Example 20, the subject matter of any one or more of Examples 13-19 optionally include wherein the stiles are secured to the intermediate rail using corrugated nails.

Example 21 is a garage door assembly comprising: a core layer defining a façade side and a back side opposite the façade side, the core layer comprising: a rail; and a plurality of stiles coupled to the rail; a backing layer adhered to the back side of the core layer; and a façade layer adhered to the façade side of the core layer, the façade layer comprising: a plurality of frame segments defining an outer surface made of polymer and the plurality of frame segments defining a mating surface made of Polyvinyl chloride, the mating surface adhered to the façade side of the core layer.

In Example 22, the subject matter of Example 21 optionally includes wherein the plurality of frame segments are made of polymer-capped Polyvinyl Chloride.

In Example 23, the subject matter of any one or more of Examples 21-22 optionally include wherein the plurality of frame segments define a plurality of joints, each joined defined at least in part by an end portion of a frame segment having an interface configured to engage an edge portion of any other of the plurality of frame segments.

In Example 24, the subject matter of Example 23 optionally includes wherein the interface of the frame segment of the plurality of joints is arcuate and concave.

In Example 25, the subject matter of Example 24 optionally includes wherein the edge portions of the frame segment of the plurality of joints is arcuate and convex.

In Example 26, the subject matter of any one or more of Examples 21-25 optionally include wherein the outer surface of the façade layer includes no exposed screws.

In Example 27, the subject matter of any one or more of Examples 21-26 optionally include wherein the outer surface of each frame segment has a continuous surface.

In Example 28, the subject matter of Example 27 optionally includes wherein the continuous surface is defined by at least three outer surfaces of the frame segment.

Example 29 is a method of manufacturing a door assembly, the method comprising: securing a plurality of stiles of a core layer to a rail of the core layer, the core layer defining a façade side and a back side opposite the façade side; adhering a backing layer to the back side of the core layer; positioning a plurality of frame segments of a façade layer such that a mating surface of the frame segments engage the façade side of the core layer and such that an outer surface of the frame segments is exposed; and adhering the mating surface to the façade side of the core layer to secure the façade layer to the core layer.

In Example 30, the subject matter of Example 29 optionally includes wherein the mating surface is made of Polyvinyl chloride and wherein the outer surface is made of a polymer.

In Example 31, the subject matter of Example 30 optionally includes wherein the plurality of frame segments include a core portion made of Polyvinyl Chloride, the core portion defining the mating surface.

In Example 32, the subject matter of Example 31 optionally includes forming a pocket through the mating surface and into the core portion.

In Example 33, the subject matter of Example 32 optionally includes securing a screw to the core portions of adjacent frame segments of the plurality of frame segments through using the pocket.

In Example 34, the subject matter of any one or more of Examples 29-33 optionally include wherein the core layer is adhered to one or more of the façade layer and the backing layer using a cold press operation.

In Example 35, the subject matter of any one or more of Examples 29-34 optionally include forming, in an end portion of one of the plurality of frame segments, an arcuate interface.

In Example 36, the subject matter of Example 35 optionally includes engaging the arcuate interface with an edge of another of the plurality of frame segments.

In Example 37, the subject matter of Example 36 optionally includes wherein the edge is convex and the arcuate interface is concave and shaped to be complimentary to the edge.

In Example 38, the subject matter of Example 29 optionally includes wherein the façade layer comprises a plurality of panels located between the plurality of frame segments.

In Example 39, the subject matter of Example 29 optionally includes securing the plurality of panels to the plurality of frame segments.

In Example 40, the apparatuses or method of any one or any combination of Examples 1-39 can optionally be configured such that all elements or options recited are available to use or select from.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A door assembly comprising:
- a core layer defining a façade side and a back side opposite the façade side, the core layer comprising:
  - a rail; and
  - a plurality of stiles coupled to the rail;
- a backing layer adhered to the back side of the core layer; and
- a façade layer adhered to the façade side of the core layer, the façade layer comprising:
  - a plurality of frame segments each including a core portion made of polyvinyl chloride, the frame segments defining an outer surface made of polymer and the core portion of the plurality of frame segments each defining a mating surface made of polyvinyl chloride adhered to the façade side of the core layer, the plurality of frame segments including a pocket extending through the mating surface and configured to receive a screw to secure the frame segments to each other.

2. The door assembly of claim 1, wherein the core layer is adhered to one or more of the façade layer and the backing layer using an adhesive.

3. The door assembly of claim 2, wherein the core layer is adhered to one or more of the façade layer and the backing layer using a cold press operation.

4. The door assembly of claim 1, wherein each of the plurality of frame segments includes an end portion, at least one frame segment of the end portions having an interface configured to engage an edge portion of any other of the plurality of frame segments.

5. The door assembly of claim 4, wherein the interface of the end portion is arcuate and concave.

6. The door assembly of claim 5, wherein the edge portion of at least one of the plurality of frame segments is arcuate and convex.

7. The door assembly of claim 1, wherein the façade layer comprises a plurality of panels located between the plurality of frame segments.

8. The door assembly of claim 7, wherein the plurality of panels are adhered to the core layer.

9. The door assembly of claim 1, wherein the door assembly is a garage door assembly.

10. A door assembly comprising:
- a core layer defining a façade side and a back side opposite the façade side, the core layer comprising:
  - a top rail;
  - an intermediate rail; and
  - a plurality of stiles coupled to the top rail and the intermediate rail;
- a backing layer adhered to the back side of the core layer; and
- a façade layer adhered to the façade side of the core layer, the façade layer comprising:
  - a plurality of frame segments defining an outer surface comprised of polyvinyl chloride and the plurality of frame segments defining a mating surface adhered to the façade side of the core layer, the plurality of frame segments including a pocket extending through the mating surface and configured to receive a screw to secure the frame segments to each other.

11. The door assembly of claim 10, wherein the top rail, the intermediate rail, and the plurality of stiles form one or more spaces therebetween, the spaces filled with polystyrene insulation.

12. The door assembly of claim 11, wherein the façade layer comprises a plurality of panels located between the plurality of frame segments.

13. The door assembly of claim 12, wherein the plurality of panels are adhered to the core layer.

14. The door assembly of claim 13, wherein the plurality of panels are adhered, at least in part, to the polystyrene insulation.

15. A garage door assembly comprising:
- a core layer defining a façade side and a back side opposite the façade side, the core layer comprising:
  - a rail; and
  - a plurality of stiles coupled to the rail;
- a backing layer adhered to the back side of the core layer; and
- a façade layer adhered to the façade side of the core layer, the façade layer comprising:
  - a plurality of frame segments defining an outer surface made of polymer and the plurality of frame segments defining a mating surface made of polyvinyl chloride, the mating surface adhered to the façade side of the core layer, the plurality of frame segments including a pocket extending through the mating surface and configured to receive a screw to secure the frame segments to each other.

16. The garage door assembly of claim 15, wherein the plurality of frame segments are made of polymer-capped Polyvinyl Chloride.

17. The door assembly of claim 15, wherein the plurality of frame segments define a plurality of joints, each joint defined at least in part by an end portion of one of the frame segments having an interface configured to engage an edge portion of any other of the plurality of frame segments.

* * * * *